US006886907B1

(12) United States Patent
Okamoto et al.

(10) Patent No.: US 6,886,907 B1
(45) Date of Patent: May 3, 2005

(54) CLEANING DEVICE FOR CLEANING PRINTHEAD OF INK-JET PRINTER

(75) Inventors: Tsugio Okamoto, Kani (JP); Takeshi Asano, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/417,096

(22) Filed: Apr. 17, 2003

(30) Foreign Application Priority Data

Apr. 19, 2002 (JP) ..... 2002-118218
Apr. 19, 2002 (JP) ..... 2002-118219

(51) Int. Cl.[7] ..... B41J 2/165
(52) U.S. Cl. ..... 347/33; 347/29
(58) Field of Search ..... 347/22, 29–35

(56) References Cited

U.S. PATENT DOCUMENTS 5,689,293 A * 11/1997 Hirano ..... 347/33

FOREIGN PATENT DOCUMENTS

| | | |
|---|---|---|
| EP | 0 653 306 A2 | 5/1995 |
| EP | 1 040 924 A1 | 10/2000 |
| JP | 02194965 | 8/1990 |
| JP | B2 2726076 | 12/1997 |
| JP | A 11-138857 | 5/1999 |
| JP | 11138857 | 5/1999 |
| JP | A 2000-43280 | 2/2000 |
| JP | 2000043280 | 2/2000 |
| JP | A 2001-30508 | 2/2001 |
| JP | 2001030508 | 2/2001 |

* cited by examiner

*Primary Examiner*—Shih-wen Hsieh
(74) *Attorney, Agent, or Firm*—Oliff & Berridge, PLC

(57) ABSTRACT

A cleaning device for cleaning a printhead of an ink-jet printer. The cleaning device includes, a cleaning unit provided with a cleaning blade, and a traveling unit that carries the cleaning unit. The traveling unit reciprocates between first and second positions to perform a cleaning cycle of the printhead. The cleaning blade is held by the cleaning unit perpendicular to an ink ejecting surface of the printhead to clean the ink ejecting surface when the traveling unit moves in one direction. Further, The cleaning blade is inclined against the ink ejecting surface to avoid being rubbed against the ink ejecting surface when the traveling unit moves in an opposite direction.

74 Claims, 12 Drawing Sheets

CLEANING DEVICE FOR CLEANING PRINTHEAD OF INK-JET PRINTER

BACKGROUND OF THE INVENTION

The present invention relates to a cleaning device for cleaning a printhead of an ink-jet printer that carries out printing by ejecting ink droplets onto a recording medium.

The ink-jet printer ejects ink droplets onto a recording medium from a plurality of nozzles formed on an ink ejecting surface of a printhead by applying instantaneous pressure to the ink within the nozzles. The instantaneous pressure is generated, for example, by elements that convert electrical energy into mechanical energy, such as a piezoelectric element, or elements that convert electrical energy into heat.

The ink-jet printer prints characters and images by ejecting ink droplets onto the recording medium and thereby forming a plurality of small dots thereon. A great advantage of such an ink-jet printer is that it can provide a high quality color image printer of a relatively simple structure by ejecting different color inks from different nozzles of the printhead. However, it should be noted there are also some problems typical to ink-jet printers.

One of such typical problems is that the ink adheres to the ink ejecting surface or nozzles of the printhead during the printing operation.

The ink adheres to the ink ejecting surface or nozzles when bubbles are generated in the ink within or near the nozzles due to temperature increase within the printer as a result of a long, continuous use thereof. These bubbles not only hinder the ink droplets ejected from the nozzles to fly toward the recording medium along expected trajectories, which causes deterioration of printing quality, but also atomize the ejected ink. The atomized ink suspends in the vicinity of the ink ejecting surface, instead of flying toward the recording medium, and a part of them adheres to the ink ejecting surface or nozzles.

The adherence of ink to the ink ejecting surface or nozzles may occur even if the bubble mentioned above are not generated. For example, some of the ejected ink droplet bounces back from the recording medium and adheres to the ink ejecting surface.

If the printer is not used for a long time with the adhered ink left on the ink ejecting surface or at the nozzle opening, the nozzle will be clogged with dried ink. Once the nozzle is clogged, the print quality begins to fade or it becomes unprintable since the amount of ejected ink decreases or no ink can be ejected.

The clogging of the nozzle with dried ink cannot be removed by merely applying pressure to the ink with the piezoelectric element or heating element mentioned above. Therefore, various methods for preventing or removing the clogging of the nozzle are provided.

Typical methods for preventing or removing clogging of the nozzle includes capping, wiping, ink suction, and preparative ink discharge (or flushing).

In capping, the ink ejecting surface of the printhead is tightly covered with a rubber cap member to prevent drying of the ink. The cap member covers the ink ejecting surface, for example, when the ink-jet printer is not in use for a long time, or, over the interim time period between one printing cycle and another.

In wiping, the ink ejecting surface of the printhead is rubbed with a blade like member at a predetermined timing or predetermined interval to wipe the ink ejecting surface clean.

In ink suction, the ink is removed from the nozzle under suction at a predetermined interval, timing, of step. In preparative ink discharge or flushing, minute dust or paper and/or fiber, for example, and small ink clots are removed from the nozzles by flushing ink from the nozzles.

It should be noted that one or a combination of the above-mentioned methods are typically used in the ink-jet printer to prevent the clogging of the nozzles of the printhead.

If wiping is carried out, the blade should be cleaned to remove the ink adhered thereto. Otherwise, the wiping becomes ineffective or ink remaining thereon drops down and makes the printer dirty. Typically, the ink remaining on the blade is removed by bringing the blade into contact with an ink absorber, or by utilizing the springing back of the blade after being bent.

Devices that prevent or remove clogging of the nozzle by practicing the above-mentioned methods are called cleaning devices or recovering devices. Such cleaning (recovering) devices are essential for the ink-jet printer to maintain high quality printing.

Japanese Patent Publication No. 2726076 discloses an ink-jet printer in which ink ejecting surfaces of printheads held in a carriage are wiped with a cleaning blade in the following manner. First, the printheads are moved out of a printing area of the printer. Then, the cleaning blade is abutted against the ink ejecting surface of the first printhead and moved along the ink ejecting surfaces in a direction along which the printheads are arranged. After having wiped off the ink ejecting surfaces, the cleaning blade is moved for a while with the tip portion thereof being rubbed against an ink absorber located behind the recording medium, and then the cleaning blade is stopped. Next, the printhead is returned to the printing area so as to avoid coming into contact again with the cleaning blade, and then the cleaning blade is moved back to the initial portion thereof.

The ink-jet printer disclosed in the above-mentioned Japanese Patent Publication, however, requires much time for the cleaning operation since the printhead is once moved out of the printing area, for allowing wiping of the ink ejecting surface with the cleaning blade, and then moved back to the printing area for allowing the cleaning blade returning to the initial position without coming into contact with the printhead.

Japanese Patent Application Provisional Publication HEI 11-138857 discloses an ink-jet printer in which a cleaning blade wipes off an ink ejecting surface of a printhead, and then moves toward an ink absorber so as to remove the ink adhered to the tip portion thereof by rubbing the tip portion against the ink absorber. The cleaning blade is bent by the ink absorber, springs back as it leaves the ink absorber and thereby scatters or removes the ink adhered to cleaning blade at portions other than the tip portion. The cleaning blade is placed in a blade holder that is coupled to a disk via a link mechanism. The disk rotates to move the blade holder, and hence the cleaning blade, up and down. After the ink adhered to the cleaning blade is removed, the cleaning blade is moved down by rotating the disk so that the cleaning blade does not come into contact with the ink ejecting surface.

Since the printer disclosed in the above mentioned publication lifts the cleaning blade up when the ink ejecting surface of the printhead is to be wiped, and moves down the cleaning blade when the cleaning blade is to be returned to the initial position, the printer requires a complicated mechanism that utilizes a rotating disk to move up and down the blade holder and also an additional motor for driving the disk.

The ink removed from the cleaning blade by the ink absorber, or the ink discharged into a cap member under suction or by flushing are typically dealt with as below.

In printers for consumer use, which are not frequently used and of which ink consuming amount is small, the ink discharged from the printhead into the cap member is absorbed by an ink absorber and then dried by air seasoning. Further, the ink adhered to the cleaning blade during the wiping operation is removed by abutting the cleaning blade against other members or dried by air seasoning.

In printers for commercial use, which are frequently used and of which ink consuming amount is large, it is required to deal with the waste ink more actively.

For example, in the printer disclosed in Japanese Patent Application Provisional Publication No. P2000-43280, an ink absorber is attached to a cleaning blade to integrally move therewith during the wiping operation. A tube is connected to the ink absorber to remove the ink within the ink absorber by suction.

In the printer disclosed in Japanese Patent Application Provisional Publication No. P2001-30508, a cleaning blade abuts against an ink absorber after the wiping operation to remove the ink remaining on the cleaning blade. The ink absorbed into the ink absorber is collected into a collecting space provided within a cap member, which caps the printhead during a purging operation, and then sucked out from the collecting space by a pump.

In the printers disclosed in the Japanese Patent Application Provisional Publications Nos. P2000-43280 and P2001-30508, however, the waste ink cannot be removed effectively since the ink is removed, by suction, after once introduced into the ink absorber attached to the cleaning blade or the ink collecting space provided within the cap member. Thus, the disposal of the waste ink cannot be carried out in sufficient speed if a recording medium of a very large size is to be printed or if a large amount of recording medium is to be printed.

Therefore, there is a need for a cleaning device that is capable of cleaning a printhead of an ink-jet printer while effectively discarding the waste ink collected during the cleaning operation.

There is also a need for a cleaning device that is capable of cleaning a printhead of an ink-jet printer with a simple structure and in a relatively short operation time.

SUMMARY OF THE INVENTION

The present invention is advantageous in that a cleaning device for cleaning a printhead of an ink-jet printer, and a method for cleaning an ink-jet printhead are provided that satisfy the above-mention needs.

According to an aspect of the invention, a cleaning device for cleaning a printhead of an ink-jet printer is provided. The cleaning device includes, a cleaning unit provided with a cleaning blade, and a traveling unit that carries the cleaning unit. The traveling unit reciprocates to perform a cleaning cycle of the printhead. The cleaning blade is held by the cleaning unit perpendicular to an ink ejecting surface of the printhead to clean the ink ejecting surface when the traveling unit moves in one direction. Further, The cleaning blade is inclined against the ink ejecting surface to avoid being rubbed against the ink ejecting surface when the traveling unit moves in an opposite direction.

In the cleaning device arranged as above, the cleaning blade can be passed by the printhead without wiping the ink ejecting surface thereof by only inclining the cleaning head against the ink ejecting surface. Therefore, the cleaning device can be configured by a simple structure. Further, since the time required for inclining the cleaning blade is quite short, the time required for the whole cleaning cycle is also relatively short.

Optionally, the cleaning device includes an ink absorber that removes ink adhered to the cleaning blade after having cleaned the printhead. The ink absorber and the cleaning blade are separate from each other.

In the above case, the ink absorber may include a first absorbing portion arranged to remove ink from a tip portion of the cleaning blade, and a second absorbing portion arranged to remove ink from a side surface of the cleaning blade.

Optionally, the second absorber portion is arranged so as to come in close contact with substantially the entire side surface of the cleaning blade when the cleaning blade is inclined against the ink ejecting surface at the first position.

Optionally, the first absorber portion is in contact with the second absorber portion so as to allow ink in the first absorber portion to infiltrate into the second absorber portion.

Optionally, the cleaning device includes an absorber vent provided in a vicinity of a lower end portion of the second absorber portion. The absorber vent faces a side of the second absorber portion opposite to the side coming into contact with the cleaning blade. The absorber vent allows ink in the second absorber portion to be discharged.

Further optionally, the cleaning device includes a cap member and a suction device. The cap member is arranged to cover at least a portion of the ink ejecting surface and receive ink discharged from the printhead. The cap member is provided with a cap vent for discharging ink received in the cap member. The suction device is connected with both of the cap vent and the absorber vent so as to be in fluid communication with the cap vent and the absorber vent. The suction device removes ink from the cap member and the second absorber portion through the cap vent and the absorber vent, respectively, by suction.

According to another aspect of the invention, the cleaning device includes a cleaning blade, a blade supporting member that supports the cleaning blade, and a first ink absorber. The blade supporting member is arranged to be movable between first and second blade positions. The cleaning blade comes into contact with the ink ejecting surface to wipe the ink ejecting surface with the tip portion thereof when the blade supporting member is at the first blade position. The cleaning blade, however, is kept apart from the ink ejecting surface if the blade supporting plate is located at the second blade position. The first ink absorber having a side surface that is inclined against the ink ejecting surface. The side surface comes into contact with the cleaning blade if the cleaning blade is located at the second blade position and thereby removes ink adhered to the cleaning blade.

Optionally, the cleaning blade is located above the first ink absorber at the second blade position.

Optionally the cleaning blade located at the second blade position contacts with the first ink absorber at substantially the entire side surface of the cleaning blade.

The cleaning device may further include a carriage that is arranged to carry the blade supporting member, and hence the cleaning blade, between a wiping start position and a wiping end position. In this case, the blade supporting member keeps the cleaning blade at the first blade position when the carriage moves from the wiping start position to the wiping end position to allow the cleaning blade wiping the ink ejecting surface of the printhead. On the contrary, the blade supporting member keeps the cleaning blade at the second blade position when the carriage moves from the wiping end position to the wiping start position to prevent the cleaning blade from coming into contact with the ink ejecting surface.

In the above case, the cleaning device may further include a blade actuating member placed adjacent to the blade supporting member movably toward and away from the blade supporting member, a first abutting member arranged to abut against and thereby move the blade actuating member toward the blade supporting member as the carriage approaches the wiping start position, and a second abutting member arranged to abut against and thereby move the blade actuating member away from the blade supporting member as the carriage approaches the wiping end position. In this case, the blade supporting member is supported pivotably about an axis parallel to the ink ejecting surface. Further, the blade actuating member make the blade supporting member to wing it to the first blade position when moved toward the blade supporting plate and allows the blade supporting member to swing to the second blade position when moved away from the blade supporting member.

Optionally, the cleaning device may include a second ink absorber that is arranged between the printhead and the wiping end position so as to come into contact with the tip portion of the cleaning blade when the cleaning blade passes by the second ink absorber while being kept at the first blade position.

Optionally, the second ink absorber is arranged such that a portion of the second ink absorber is in contact with the first ink absorber. Further optionally, the second ink absorber is integrally formed to the first ink absorber.

The cleaning device may be further provided with an absorber vent formed in the vicinity of a lower end portion of the first ink absorber at a side opposite to the side surface coming into contact with the cleaning blade so that ink absorbed into the first ink absorber can be discharged through the absorber vent.

Optionally, the cleaning device is arranged such that the cleaning blade comes into contact with the first ink absorber at a portion other than the lower end portion of the first ink absorber.

The cleaning device may further include a cap member, a single suction pump, and a connecting mechanism. The cap member covers at least a part of the ink ejecting surface and receives ink discharged from the ink ejecting surface. The cap member is provided with a cap vent. The ink received in the cap member is discharged through the cap vent. The connecting mechanism selectively connects one of the cap vent and the absorber vent with the single suction pump.

In some cases, the cleaning device further includes a cap member arranged to cover at least a part of the ink ejecting surface of the printhead and receive ink discharged from the printhead during a purge operation.

In the above case, the cap member covers the ink ejecting surface during the purge operation and moves away fronm the ink ejecting surface after the purge operation. The carriage reciprocates between the wiping start position and the wiping end position to allow the cleaning blade wiping the ink ejecting surface after the cap member has moved away from the ink ejecting surface. Alternatively, the carriage moves from the wiping end position to the wiping start position, stays at the wiping start position with the cleaning blade located at the first blade position until the purge operation is carried out, and then moves back to the wiping end position.

According to still another aspect of the invention, there is provided a method for cleaning an ink-jet printhead. The method includes covering at least a part of an ink ejecting surface of the printhead with a cap member, the cap member being formed to receive ink discharged from the ink ejecting surface during a purge operation of the printhead; moving the cap member away from the printhead after the purge operation to uncover the ink ejecting surface; moving a cleaning blade after the purge operation from a wiping end position to a wiping start position while keeping the cleaning blade at a non-wiping attitude, the ink ejecting surface being not wiped when the cleaning blade kept at the non-wiping attitude passes by the ink ejecting surface; moving back to the cleaning blade from the wiping start position to the wiping end position while keeping the cleaning blade at a wiping attitude, the ink ejecting surface being wiped when the cleaning blade kept at the wiping attitude passes by the ink ejecting surface; and waiting for next purge operation with the cleaning blade located at the wiping end position.

According to still another aspect of the invention, a method for cleaning an ink-jet printhead is provided that includes moving a cleaning blade from a wiping end position to a wiping start position while keeping the cleaning blade at a non-wiping attitude, the ink ejecting surface being not wiped when the cleaning blade kept at the non-wiping attitude passes by the ink ejecting surface; covering at least a part of the ink ejecting surface with a cap member after the cleaning blade is moved to the wiping starting position, the cap member formed to receive ink discharged from the ink ejecting surface during a purge operation of the printhead; moving the cap member away from the printhead after the purge operation to uncover the ink ejecting surface; moving back the cleaning blade from the wiping start position to the wiping end position after the cap member is moved away from the printhead, the cleaning blade being moved while keeping the cleaning blade at a wiping attitude, the ink ejecting surface being wiped when the cleaning blade kept at the wiping attitude passes by the ink ejecting surface; and waiting for next purge operation with the cleaning blade located at the wiping end position.

According to still another aspect of the invention, a method for cleaning an ink-jet printhead is provided, which includes covering at least a part of an ink ejecting surface of the printhead with a cap member, the cap member formed to receive ink discharged from the ink ejecting surface during a purge operation of the printhead; moving the cap member away from the printhead after the purge operation to uncover the ink ejecting surface; moving a cleaning blade after the purge operation from a wiping start position to a wiping end position while keeping the cleaning blade at a wiping attitude, the ink ejecting surface being wiped when the cleaning blade kept at the wiping attitude passes by the ink ejecting surface; moving back the cleaning blade from the wiping end position to the wiping start position while keeping the cleaning blade at a non-wiping attitude, the ink ejecting surface being not wiped when the cleaning blade kept at the non-wiping attitude passes by the ink ejecting surface; and waiting for next purge operation with the cleaning blade located at the wiping start position.

BRIEF DESCRIPTION OF THE ACCOMPANYING DRAWINGS

Figure 6B:
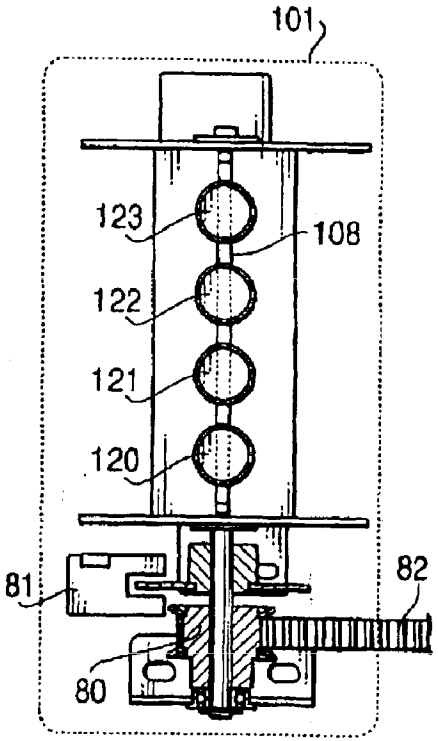
Figure 6A:
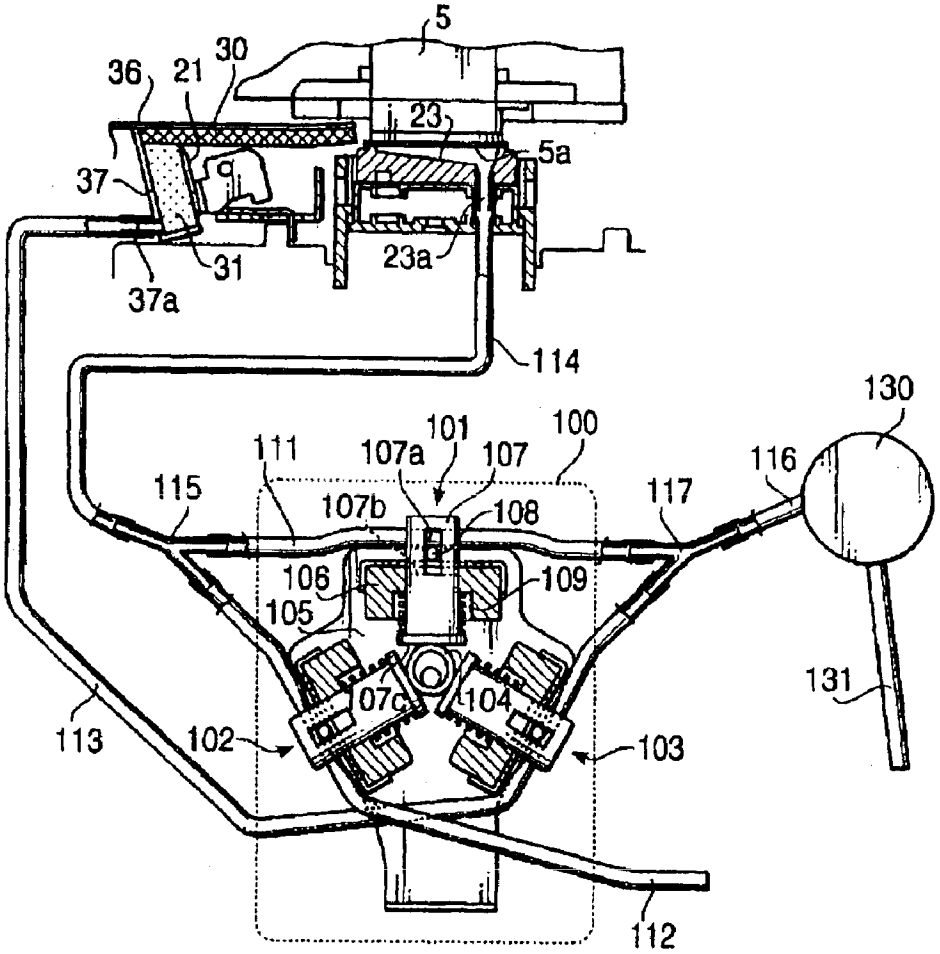
Figure 7A:
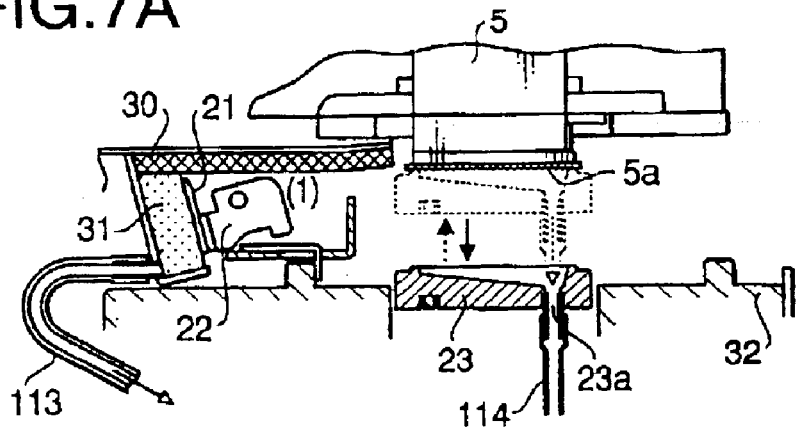
Figure 7B:
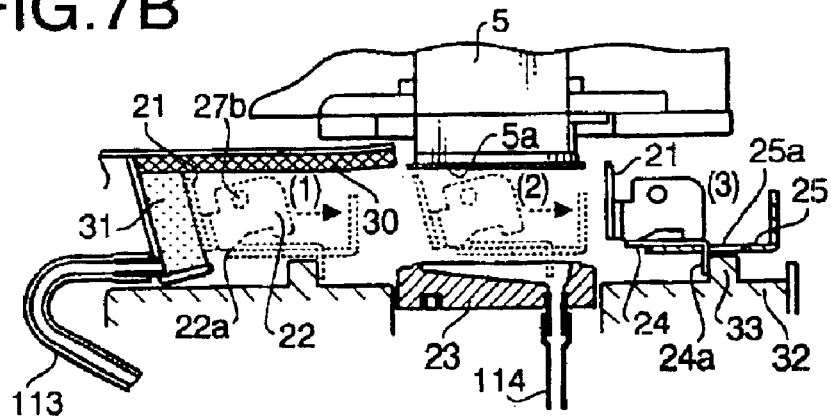
Figure 7C:
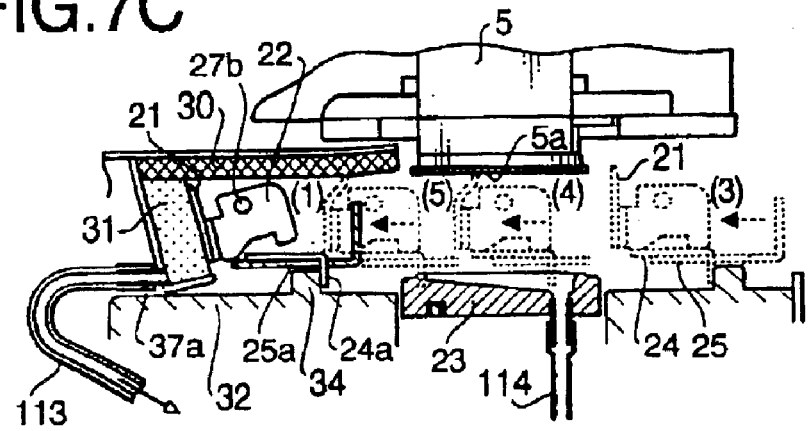
Figure 8:
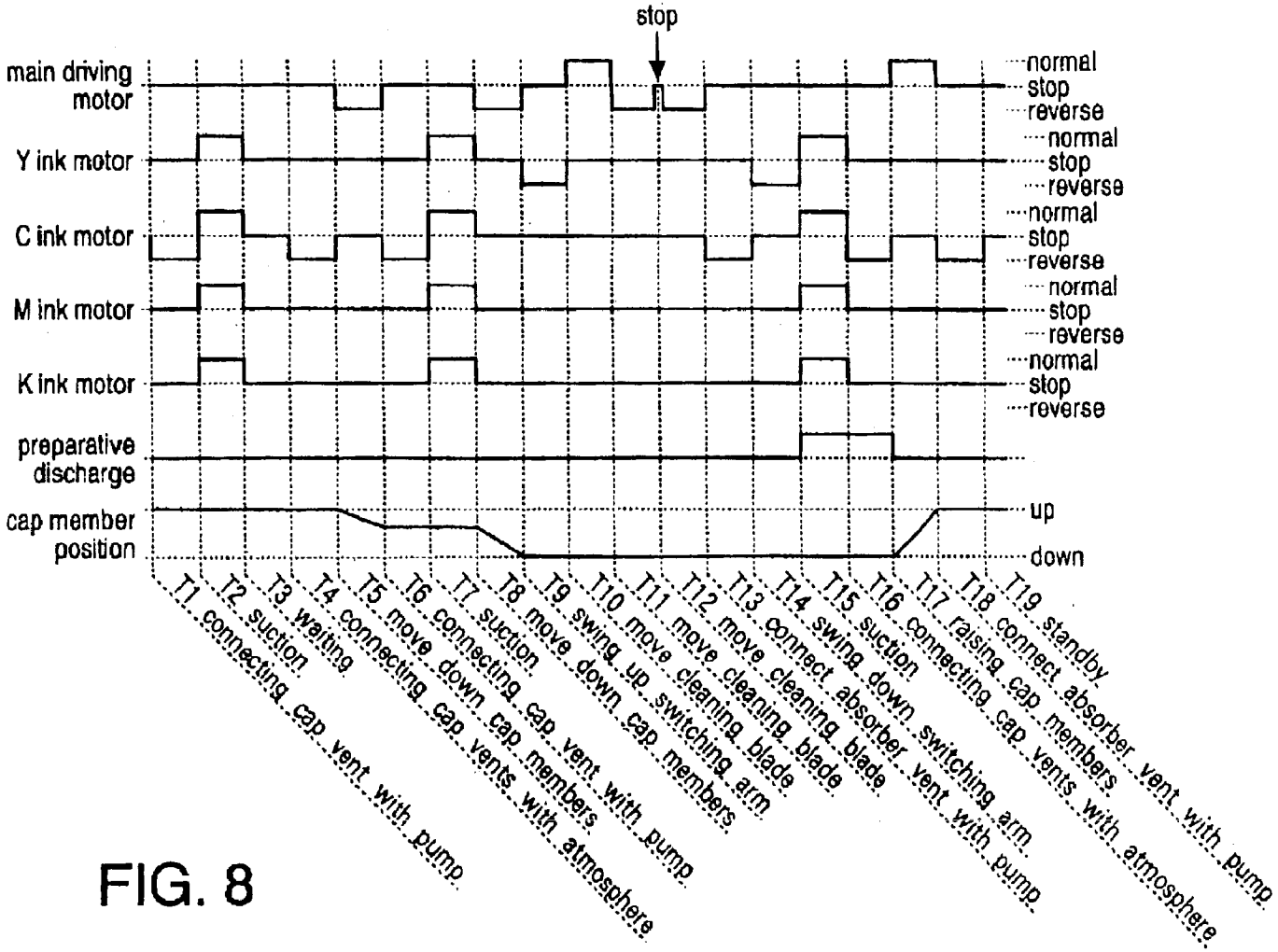
Figure 9A:
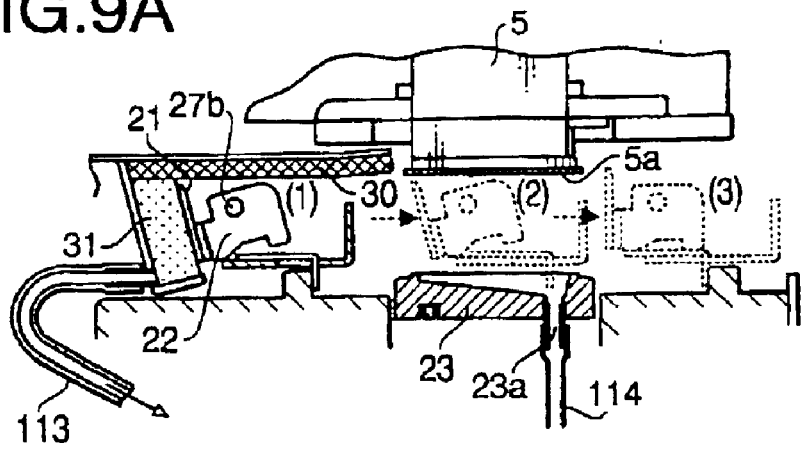
Figure 9B:
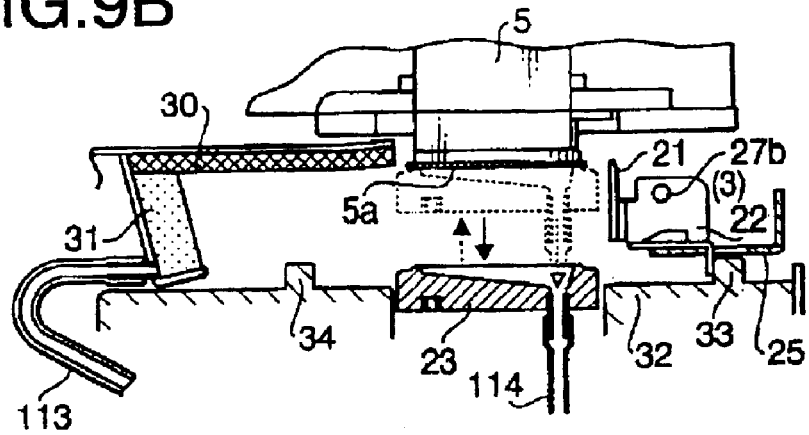
Figure 9C:
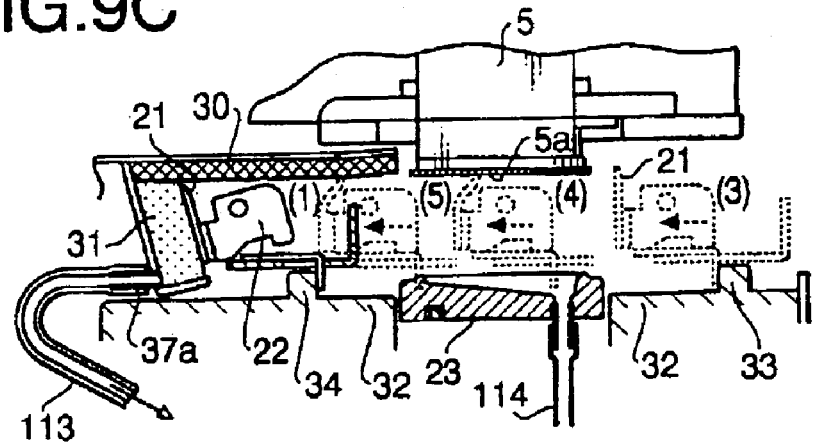

FIG. 6A schematically illustrates a waste ink discharging channel system of the cleaning device and a valve unit for controlling the flow thereof;

FIG. 6B is a top view of a first valve mechanism shown in FIG. 6A;

FIGS. 7A through 7C schematically illustrate an exemplary cleaning process performed by the cleaning device according to the embodiment of the invention;

FIG. 8 is a timing chart of the general operation of the cleaning device according to the embodiment of the invention;

FIG. 9A through 9C illustrate a variation of the cleaning process performed by the cleaning device according to the embodiment of the invention.

Figure 10:
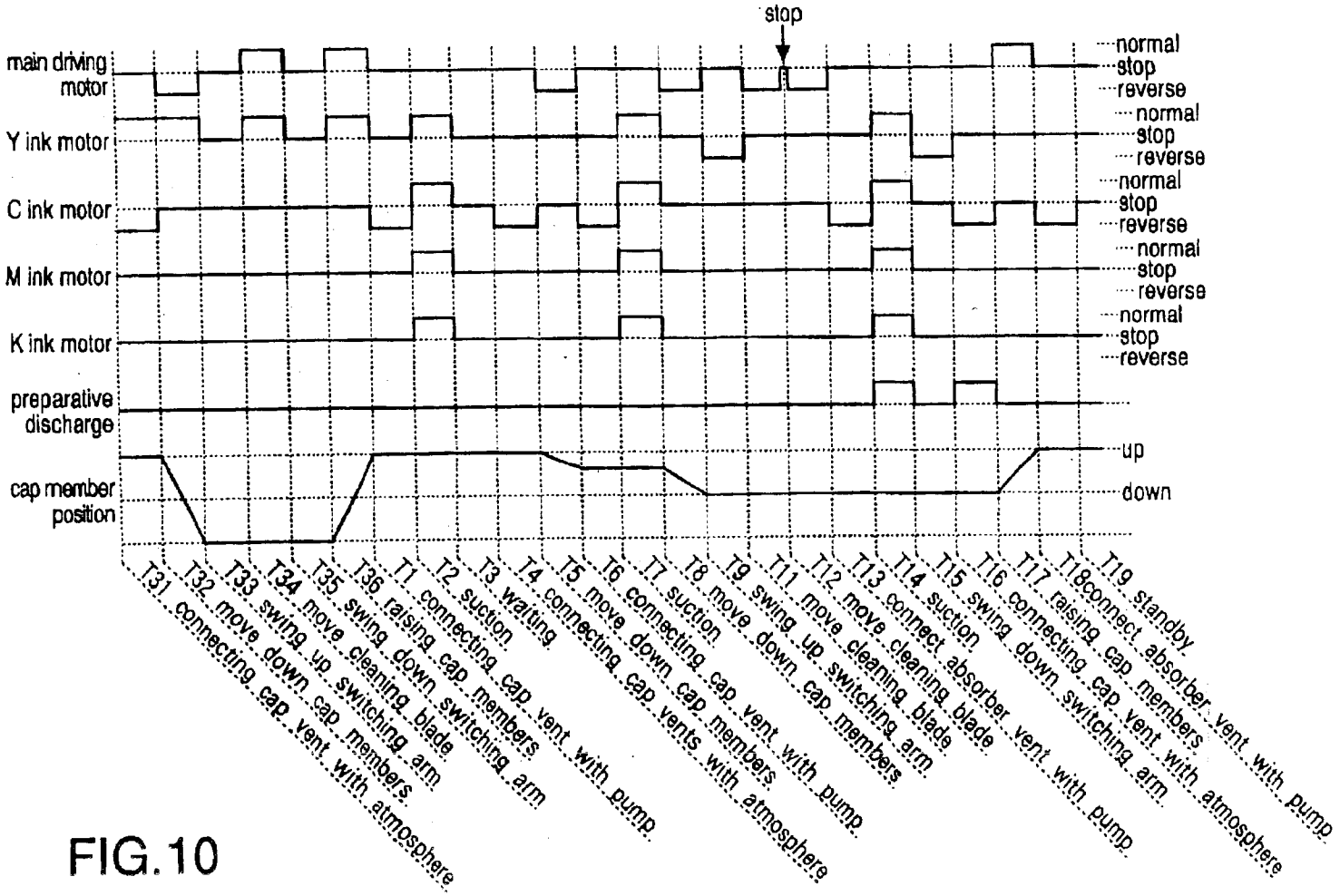
Figure 11A:
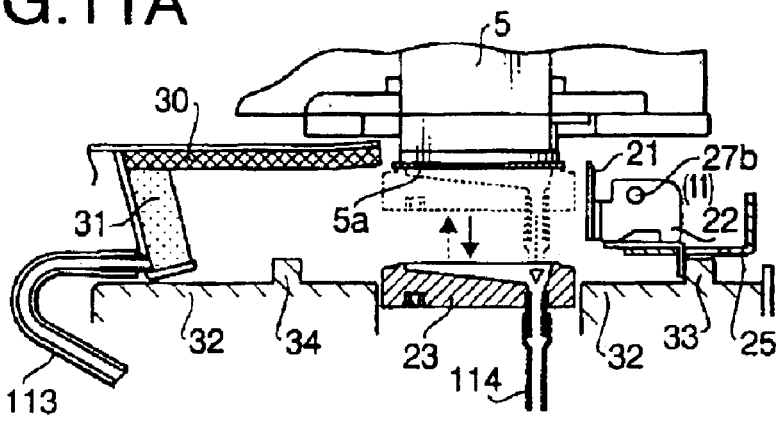
Figure 11B:
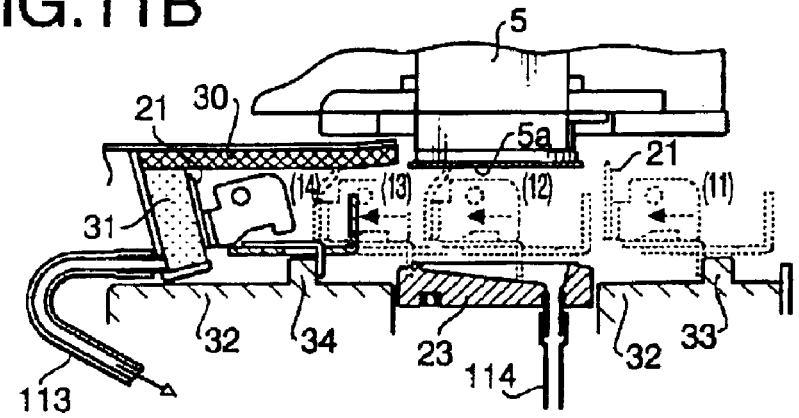
Figure 11C:
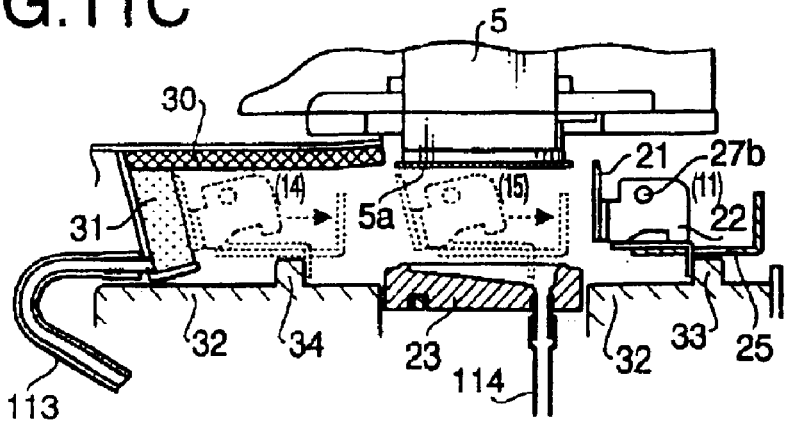
Figure 12:
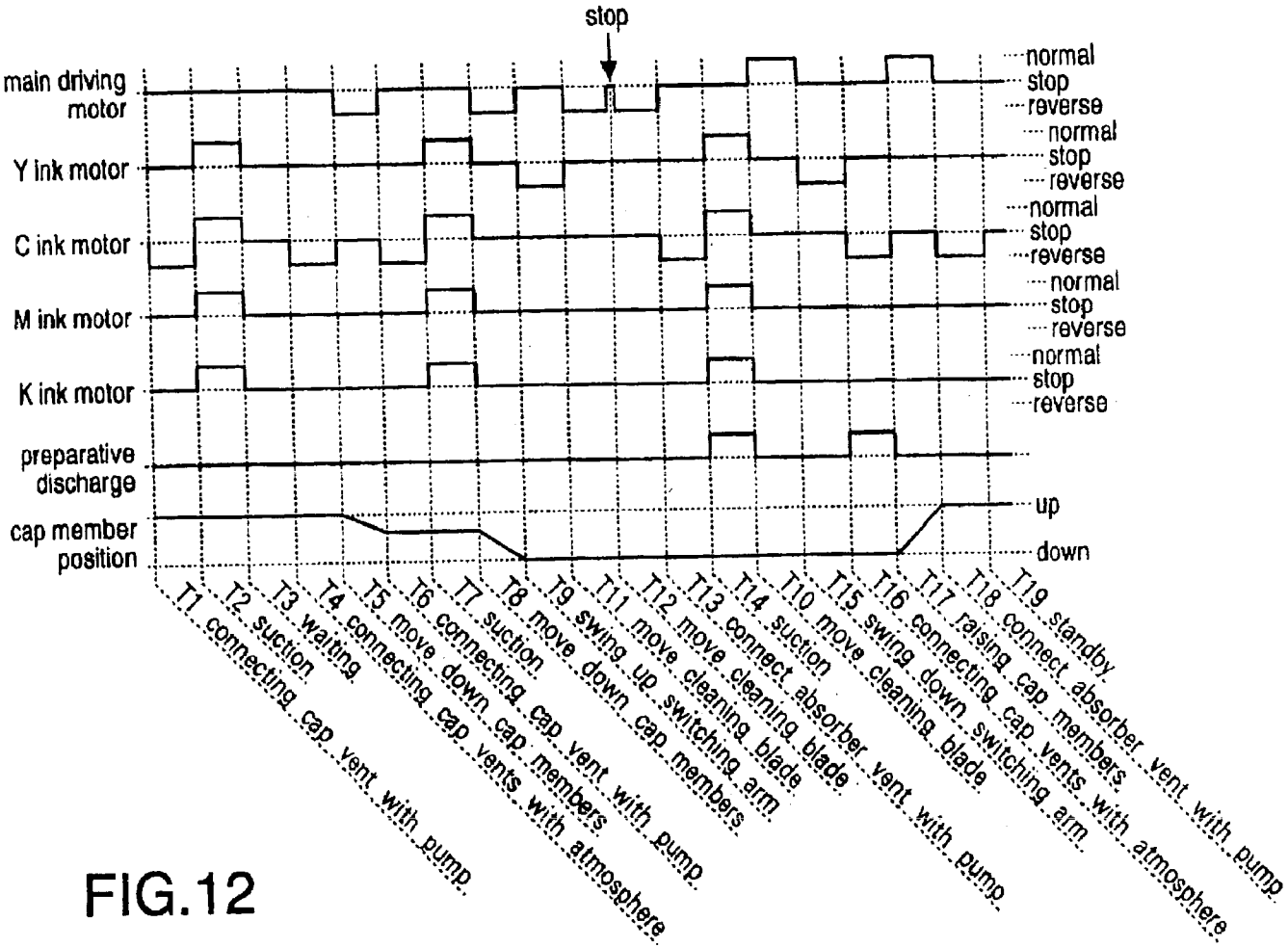

FIG. 10 is a timing chart of the operation of the cleaning device performing the variation of the cleaning process shown in FIGS. 9A through 9C;

FIGS. 11A through 11C illustrate another variation of th cleaning process performed by the cleaning device according to the embodiment of the invention; and FIG. 12 is a timing chart of the operation of the cleaning device performing the another variation of the cleaning process shown in FIGS. 11A through 11C.

DETAILED DESCRIPTION OF THE EMBODIMENTS

Hereinafter, an embodiment of the invention will be described with reference to the accompanying drawings.

Initially, a general configuration of an ink-jet printer 1 to which a cleaning device 6 according to the embodiment of the invention is applied will be described with FIG. 1.

Figure 1:
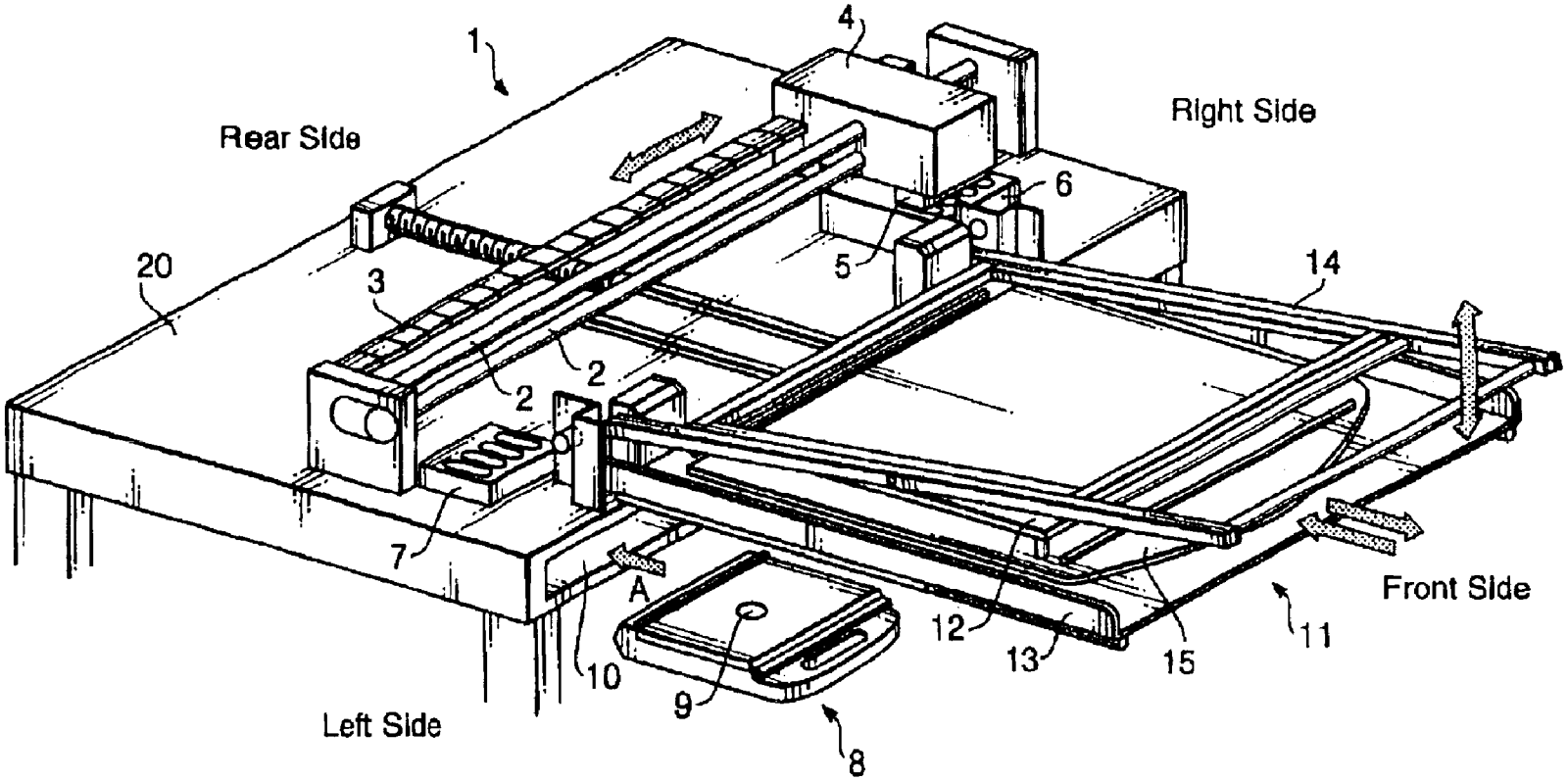
FIG. 1 is a perspective view of an ink-jet printer to which a cleaning device according to an embodiment of the invention is applied.

FIG. 1 is a perspective view of the ink-jet printer 1. The ink-jet printer 1 is for commercial use and utilized for printing on a cloth and/or clothes such as T-shirts, for example. Note that the front, rear, right and left sides of the ink-jet printer 1 are respectively defined as shown in FIG. 1.

Main portions of the ink-jet printer 1 are mounted to a frame 20. The main portions of the ink-jet printer 1 includes a printing unit, a recovering unit that cleans a printhead 5 to prevent or remove clogging, and a platen unit to which the recording medium or the cloth is to be set.

The printing unit includes the printhead 5, a carriage 4 for holding ink cartridges (not shown), one or more guide shafts 2 along which the carriage 4 reciprocally slides to right and left (i.e., in a main scanning direction), and a driving belt 3 that is coupled with the carriage 4 to transmit a driving force thereto for moving back and forth.

The recovering unit includes the cleaning device 6, a flushing unit 7, and a waste ink pooling device 8. The cleaning device 6 recovers or carries out cleaning of the printhead 5 at a predetermined interval when the printhead 5 is placed at an initial position (at the right side of the frame 20). The flushing unit 7 receives waste ink discharged from the printhead 5 that is moved to the left side of the fame 20 during the printing process to perform preparative discharge or flushing. The waste ink discharged from the cleaning device 6 or the flushing unit 7 flows into the waste ink pooling device 8, which is set into a placement opening 10, through an opening 9.

The platen unit 11 includes a guide plate 15 that guides the recording medium such as T-shirts, a platen 12 on which the printer area of the recording medium is to be placed, and a frame 14 that fixes the recording medium to the platen 12.

Next, the general operation of the ink-jet printer 1 will be described.

When a user depresses a platen operation switch (not shown), the platen 12, which has been at a print position in the ink-jet printer 1, slides out from the ink-jet printer 1 to be located at a recording medium setting position as shown in FIG. 1. Then, the user opens the platen unit 11 by lifting up the frame 14, and place the recording medium on the platen 12. Then, the user moves down the frame 14 to close the platen unit 11 and thereby fix the recording medium to the platen unit 11. Next, a print starting switch (not shown) is depressed to slide back the platen unit 11 to the print position.

After the platen unit 11 has returned to the print position, the printing operation starts. That is, the driving belt 3 drives the carriage 4, which holds the printhead 5, back and forth in the main scanning direction while the printhead 5 discharges ink droplets onto the recording medium. After the carriage 4 has reciprocated once in the main scanning direction, the platen unit 11 is moved in a direction perpendicular to the main scanning direction, or auxiliary scanning direction, for one step of a predetermined length, and then the next line in the main scanning direction is printed. By repeating the operation described above, a predetermined pattern is printed on the recording medium.

The printhead 5 is provided with a plurality of nozzle groups (four groups in the present embodiment), each corresponding to different color ink. The ink cartridges containing different color inks are held by the carriage 4. During the printing operation, the ink cartridge supply color inks through separate ink supplying conduits to respective nozzle groups.

The waste ink that is discharged from the printhead 5 or sucked out from the printhead 5 at the cleaning device 6 in order to purge the printhead 5, and also the waste ink that is flushed from the printhead 5 at the flushing unit 7 flow through respective waste ink discharging conduits (not shown) to a tube (not shown) located above the opening 9 of the waste ink pooling device 8 inserted into the ink-jet printer 1. The waste ink drops wound from the tube into the wast ink pooling device 8 through the opening 9.

Next, the configuration of the cleaning device 6 according to the embodiment of the invention will be described.

Figure 2:
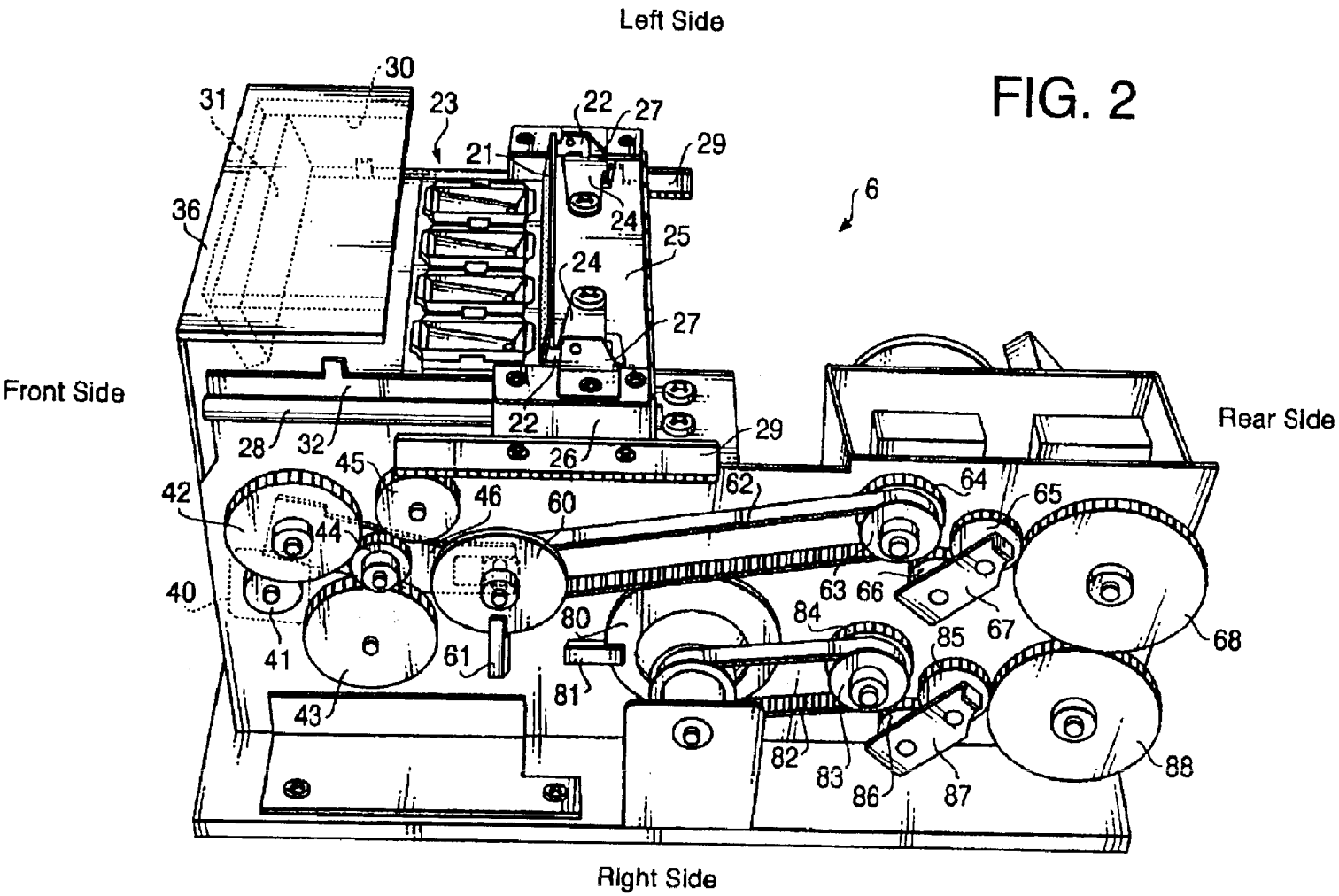
FIG. 2 is a perspective view of the cleaning device according to the embodiment of the invention.

FIG. 2 is a perspective view of the cleaning device 6 according to the embodiment of the invention. Note that the right and left hand sides in FIG. 2 corresponds to the rear and front sides of the cleaning device 6, respectively, and the near and far sides in FIG. 2 to the right and left sides of the cleaning device 6, respectively.

The cleaning device 6 shown in FIG. 2 includes a wiping unit and a capping unit, as well as a main driving unit and a main driving force transmitting unit for actuating the wiping unit and the capping unit. Further, the cleaning device 6 includes, Y (yellow) ink pump driving unit, capping switching unit, C (cyan) ink pump driving unit, valve switching unit, and a base plate 32 to which the above-mentioned units are mounted.

Figure 3:
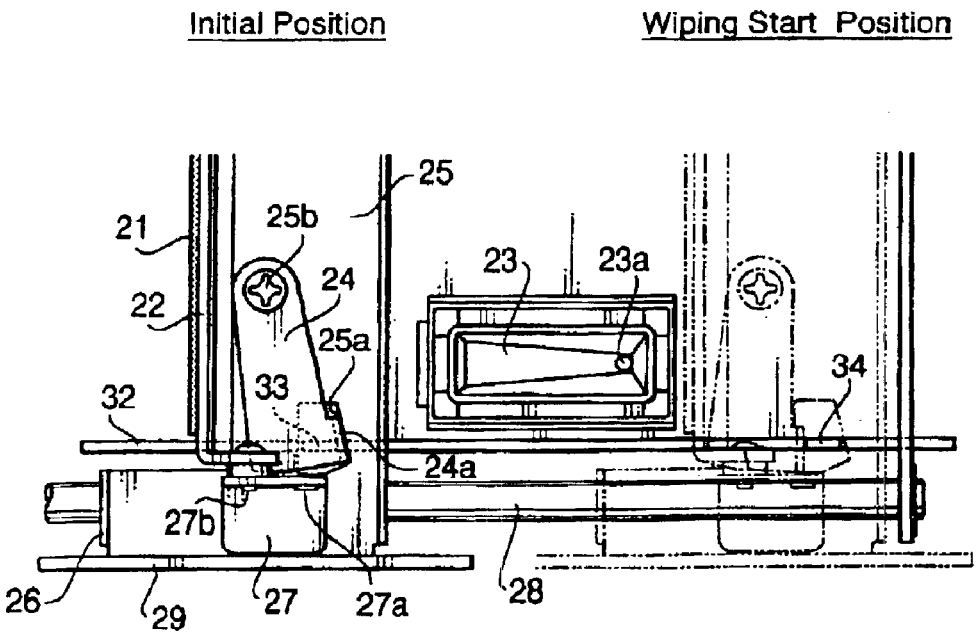
FIG. 3 is a top view of the wiping unit and the capping unit of the cleaning device shown in FIG. 2.

Hereinafter, the configuration of the wiping unit and the capping unit will be described in detail with reference to FIGS. 2 through 4. FIG. 3 is a top view of the wiping unit and the capping unit of the cleaning device 6 shown in FIG. 2, and FIG. 4 illustrates the operation of the wiping unit and the capping unit of the cleaning device 6 shown in FIG. 2.

Figure 4:
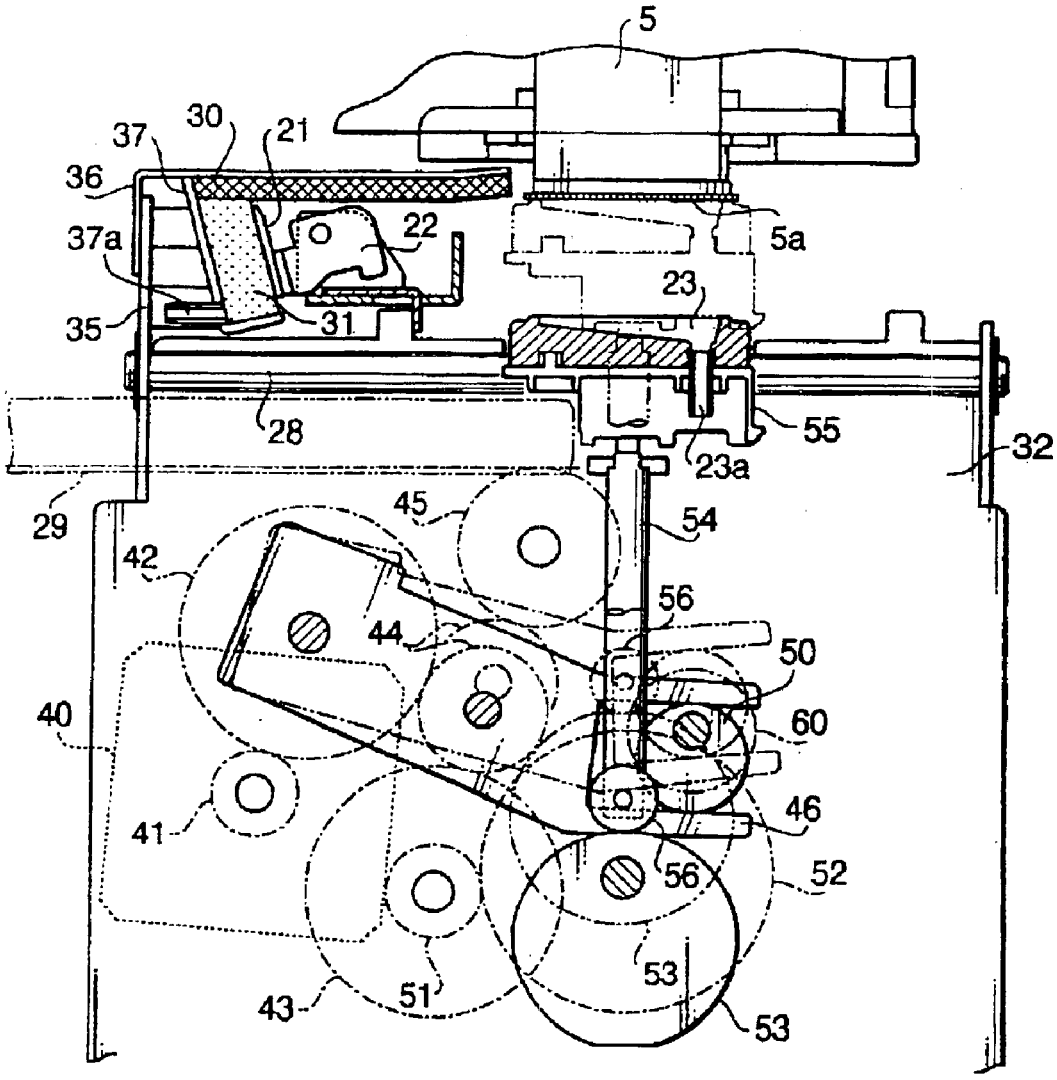
FIG. 4 illustrates the operation of the wiping unit and the capping unit of the cleaning device shown in FIG. 2.

As shown in FIG. 2, the wiping unit has a cleaning blade 21, a blade support plate 22, a pair of blade actuating plates 24, a carriage plate 25, a carriage 26, a pair of brackets 27, a pair of guide shafts 28 (only one is shown), rack gears 29, a first absorber 31, a second absorber 30, and an absorber supporting plate 35 (see FIG. 4).

As shown in FIG. 4, the capping unit includes a plurality of cap members 23 (see also FIG. 2), a cap supporting member 55, a cap supporting rod 54, a cam follower 56, an eccentric cam 53, and a cam rotating gear 52.

As can be seen in FIG. 2, the carriage 26 is slidably mounted to the guide shafts 28 (only one is shown) so as to be movable back and forth (in right and left direction in FIG. 2). The guide shafts 28 are arranged in parallel with an ink ejecting surface 5*a* of the printhead 5. The carriage plate 25 is fixed on the carriage 26 so as to extend over the base plate 32 and being substantially parallel to the ink ejecting surface 5*a* of the printhead 5.

Each blade actuating plate 24 is mounted on the upper surface of the carriage plate 25 pivotably for a predetermined angle. The brackets 27 are also fixed on the carriage plate 25. Each bracket 27 is formed in an L like shape, while the blade supporting plate 22 is formed in a U like shape. The blade supporting plate 22 is pivotably coupled to the upright portion of the L shaped brackets 27 by means of supporting pins 27*b* so as to be able to swing for a predetermined angle about an axis parallel to the ink ejecting surface 5*a* of the printhead 5 (see FIG. 4).

The cleaning blade 21 is attached to a side surface of the blade supporting plate 22. The cleaning blade 21 is made from a flexible material, such as rubber, and wipes the ink ejecting surface 5*a* of the printhead 5 to clean unwanted ink thereon.

As shown in FIG. 3, a coil spring 27*a* is provided between the blade supporting plate 22 and the bracket 27 to bias the blade supporting plate 22. One end of the coil spring 27*a* is connected to the blade supporting plate 22, while the other end thereof is fixed to a side of the upright portion of the bracket 27. The coil spring 27*a* biases the blade supporting plate 22 (in a counter clockwise direction in FIG. 2) so that the side surface of the blade supporting plate 22 inclines against the ink ejecting surface 5*a* of the printhead 5.

One end of the blade actuating plate 24 is mounted on the carriage plate 25 by means of a screw 25*b* such that the blade actuating plate 24 can swing about the screw 25*b* for a predetermined angle. The blade actuating plate 24 has a bent portion 24*a* that extends downwardly through an opening 25*a* formed to the carriage plate 25. The bent portion 24*a* moves within the opening 25*a* between two opposing sides thereof as the blade actuating plate 24 swings right and left. Thus, the swinging angle of the blade actuating plate 24 is restricted by the opening 25*a*.

When the blade actuating plate 24 swings in left hand side direction in FIG. 3 until the bent portion 24*a* abuts against one side of the opening 25*a*, the blade actuating plate 24 slides under the blade supporting plate 22, abuts against the under surface of the blade supporting plate 22 to move it against the biasing force of the coil spring 27*a* to an upright position, or upright attitude, at where the cleaning blade 21 attached to the blade supporting plate 22 becomes substantially perpendicular to the ink ejecting surface 5*a* of the printhead 5.

On the contrary, if the blade actuating plate 24 swings in the opposite direction, right hand side direction in FIG. 3, until the bent portion 24*a* abuts against the other side of the opening 25*a*, the blade actuating plate 24 slides away from the blade supporting plate 22 to allow the coil spring 27*a* biasing back the blade supporting plate 22 to an inclined position (inclined attitude) at where the cleaning blade 21 is inclined against the ink ejecting surface 5*a*.

It should be noted that, in FIG. 3, the wiping unit represented by solid lines is located at an initial position (standby position, wiping end position), which is at the left hand side in FIG. 3, while the wiping unit represented in broken lines is located at a wiping start position, which is at the right hand side in FIG. 3. Details on the initial position and the wiping start position will be described later.

Referring back to FIG. 2, each rack gear 29 is fixed to the side of the carriage 26. Each rack gear 29 is engaged with a pinion gear 45. Thus, the carriage 26 moves back and fourth horizontally (in the right and left direction in FIG. 2) along the guide shafts 28, which are mounted to the base plates 32, as the pinion gear 45 rotates in counterclockwise and clockwise directions. Note that only one of the guide shafts 28 is shown in FIGS. 2 through 4 although another one is provided at the left side of the cleaning device 6.

As shown in FIG. 4, the first absorber 31 is supported by a first absorber supporting member 37 so as to include for a predetermined angle against a direction perpendicular to the ink ejecting surface 5*a* (against the vertical direction in the present embodiment). The inclination of the first absorber supporting member 37 is adjusted such that the entire side surface of the cleaning blade 21 comes into contact with the first absorber 31 when the wiping unit is located at the initial position and the cleaning blade 21 is disposed at the inclined position. The first absorber 31 removes the ink adhered to the side surface of the cleaning blade 21 so that the cleaning blade 21 can keep high wiping ability.

A plurality of absorber vents 37*a* are provided to the first absorber supporting member 37 adjacent to the lower portion of the first absorber 31, although only one is shown in FIG. 4, for sucking out ink from the first absorber 31. The number of the absorber vents 37*a* is equal to the number of the nozzle groups or the number of the color ink to be utilized, that is, four in the present embodiment. The absorber vents 37*a* are arranged in one line in the direction substantially parallel to the ink ejecting surface 5*a* of the printhead and substantially perpendicular to the direction along which the wiping unit travels.

The second absorber 30 is supported by a second absorber supporting member 36 at a location where it will be rubbed with the tip portion of the cleaning blade 21 moved horizontally below the second absorber 30 while being kept at the upright position. The second absorber 30 removes the ink adhered to the tip portion of the cleaning blade 21 so that the calculating blade 21 can effectively wipe the ink ejecting surface 5*a*.

Note that the first and second absorber supporting members 37 and 36 are fixed to the absorber supporting plate 35 by means of screws.

The cleaning device 6 is further provided with four cap members 23 (see also FIG. 2), each corresponding to one of the C (cyan) ink, M (magenta) ink, Y (yellow) ink, and K (black) ink. Each of the cap members 23 is arranged to cover an area of the ink ejecting surface 5*a* of the printhead 5 that includes the nozzle group associated with the corresponding color ink.

Each cap member 23 is provided with a cap vent 23*a* formed at the bottom thereof (see FIG. 3). The ink sucked out from the printhead 5 and received in the cap member 23 will be discharged through the cap vent 23*a*.

As shown in FIG. 4, the cap members 23 are supported by the cap supporting member 55 which is fixed to the top and of the cap supporting rod 54. The cam follower 56 is rotatably provided at the bottom end of the cap supporting rod 54. The cam follower 56 follows the periphery of the eccentric cam 53, which is rotated by the cam rotating gear 52.

The cam rotating gear 52 is engaged with the transmission gear 51 at any time. The transmission gear 51 is concentrically coupled with the cap gear 43 to rotate integrally therewith. If the cap member 43 is engaged with and driven by a main driving planet gear 44, the driving force is transmitted to the eccentric cam 53. As a result, the eccentric cam 53 rotates and the cap members 23 move up and down.

Next, the configuration of main driving unit and the main driving force transmitting unit will be described with reference to FIGS. 2 and 4.

The main driving unit and the main driving force transmitting unit includes a main driving motor 40, a main driving motor 41, a transmission gear 42, the cap gear 43, the main driving planet gear 44, the pinion gear 45, and a main drive switching arm 46.

The main driving motor 40 is the source of power of the main driving unit. The main driving motor gear 41 is attached to the spindle shaft of the main driving motor gear 41 and engaged with the transmission gear 42 all the time. Further, the transmission gear 42 is engaged with the main driving planet gear 44 all of the time. Thus, both the transmission gear 42 and the main driving planet gear 44 rotate in accordance with the rotation of the main driving motor 40.

The main drive switching arm 46 is swingably coupled with the shaft of the transmission gear 42 at one end thereof. The main driving switching arm 46 rotatably supports the main driving planet gear 44 at substantially the center thereof. Further, the main drive switching arm 46 is provided with a U shaped groove formed at the other end thereof. The U shaped groove receives the eccentric cam 50 therein. Thus, the main driving switching arm swings up and down as shown by broken lines in FIG. 4 as the eccentric cam 50 rotates.

When the main drive switching arm 46 is lifted up by the eccentric cam 50, the main driving planet gear 44 engages with the pinion gear 45. In this case, the driving force generated by the main driving motor 40 is transmitted to the rack gear 29 via the pinion gear 45 to move the carriage 26 horizontally, or between the initial position and the wiping start position. It should be noted that the movement and position of the wiping unit can be precisely controlled since the driving force is transmitted by a gear mechanism as above.

If the main driving switch arm 46 is moved downwards by the eccentric cam 50, the main driving planet gear 44 engages with the cap gear 43. In this case, the driving force is transmitted from the main driving motor 40 to the eccentric cam 53 through the cap gear 43, transmission gear 51 and the cam rotating gear 52. The eccentric cam 53 rotates and thereby moves the cap members 23 up and down.

next, the configurations of the Y ink pump driving unit and the capping switching unit will be described with reference to FIGS. 2, 4 and 5.

Figure 5:
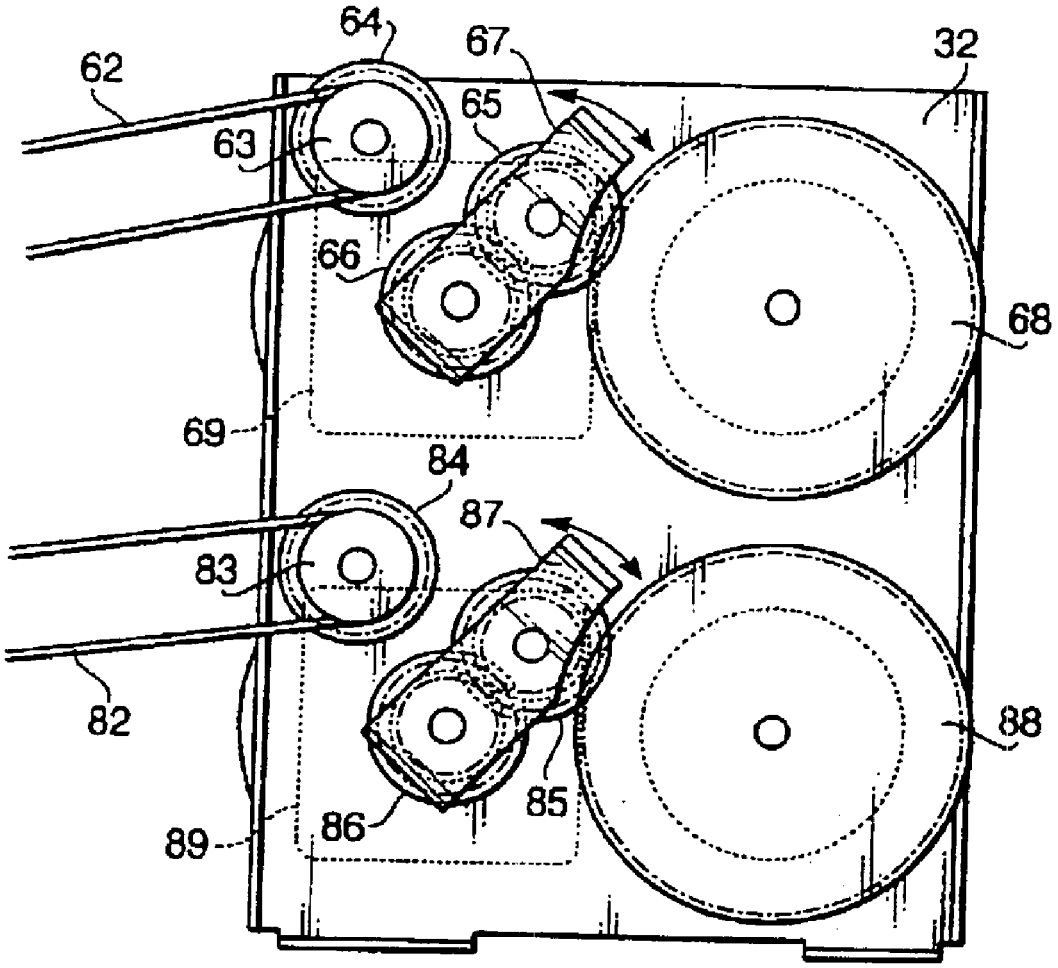
FIG. 5 shows a part of the right side of the cleaning device shown in FIG. 2.

As shown in FIG. 5, the Y ink pump driving unit and the capping switching unit includes a Y ink motor 69, a Y ink motor gear 66, a Y ink switching arm 67, a Y link planet gear 65, a Y input pump gear 68, a Y ink belt 62, a Y ink transmission gear 64, a Y ink transmission pulley 63, a main drive switching pulley 60 (see FIG. 2), a main drive switching pulley sensor 61 (see FIG. 2), and a Y ink pump (not shown).

Referring to FIG. 5, the Y ink motor 69 is the source of power of the Y ink pump driving unit and the capping switching unit. The Y ink motor gear 66 is attached to the spindle shaft of the Y ink motor 69. The Y ink motor gear 66 is engaged with the Y ink planet gear 65 all the time. The Y ink planet gear 65 is rotatably supported by the Y ink switching arm 67. The Y ink switching arm 67 is pivotably mounted to the spindle shaft of the Y ink motor 69. Thus, the Y ink switching arm 67 swings in both clockwise and counter clockwise directions if the Y ink motor 69 is rotated in normal and reverse directions, respectively, and selectively engages with one of the Y ink pump gear 68 and Y ink transmission gear 64. If the Y ink motor 69 rotates in clockwise direction in FIG. 5, the Y ink planet gear 65 engages with the Y ink pump gear 68 and actuates the Y ink pump (not shown). If the Y ink motor 69 rotates in clockwise direction in FIG. 5, the Y ink planet gear 63 engages with the Y ink transmission gear 64.

The Y ink transmission pulley 63 is concentrically coupled with the Y ink transmission gear 64, and a Y ink belt 62 is wrapped around the Y axis transmission pulley 63. The Y ink belt 62 is also wrapped around the main drive switching pulley 60 (see FIG. 2). Accordingly, if the Y ink transmission gear 64 is rotated, the driving force is transmitted to the main drive switching pulley 60 via the Y ink transmission pulley 63 and the Y ink belt 62. As a result, the main drive switching pulley 60 rotates and the eccentric cam 50 (see FIG. 4) coupled thereto also rotates. The rotation of the eccentric cam 50 causes the main drive switching arm 46 to move up and down.

The rotational position of the main drive switching pulley 60, and hence the rotational position of the eccentric cam 50, is detected by the main drive switching pulley sensor 61. The position of the main drive switching arm 46 can be controlled based on the output of the main drive switching pulley sensor 61.

Next, the configurations of the C ink pump driving unit and the valve switching unit will be described with reference to FIGS. 2 and 5.

The C ink pump driving unit and the valve switching unit include a C ink motor 89, a C ink motor gear 86, a C ink switching arm 87, a C ink planet gear 85, a C ink valve 121 (see FIG. 6B), a C ink pump gear 88, a valve driving belt 82, a C ink transmission gear 84, a C ink transmission pulley 83, a valve switching pulley 80, a valve switching pulley sensor 81, and a C ink pump which is not shown.

The C ink motor 89 is the source of power of the C ink pump driving unit and the valve switching unit. The spindle shaft of the C ink motor 89 is provided with the C ink motor gear 86 which is in engagement with the C ink planet gear 85 all the time. The C ink planet gear 85 is rotatably supported by the C ink switching arm 87. The C ink switching arm 87 is pivotably mounted to the spindle shaft of the C ink motor 89. The C ink switching arm 87 swings in both clockwise and counterclockwise directions as the C ink motor 89 rotates in normal and reverse directions, respectively, and selectively engages with one of the C ink pump gear 88 and C ink transmission gear 84. If the C ink motor 89 rotates in the clockwise direction in FIG. 5, the C ink planet gear 85 engages with the C ink pump gear 88 and actuates the C ink pump (not shown). If the C ink motor 89 rotates in the counterclockwise direction in FIG. 5, the C ink planet gear 85 engages with the C ink transmission gear 84.

The C ink transmission pulley 83 is concentrically coupled with the C ink transmission gear 84, and the valve driving belt 82 is wrapped around the C ink transmission pulley 83. The valve driving belt 82 is also wrapped around the valve switching pulley 80 (see FIG. 2). Accordingly, if the C ink transmission gear 84 is rotated, the driving force is transmitted to the valve switching pulley 80 via the C ink transmission pulley 83 and the valve driving belt 82. As a result, the valve switching pulley 80 rotates and an eccentric cam 104 (see FIG. 6B) coupled thereto also rotates. As will be described later, first, second and third valves mechanisms (101, 102, 103) are selectively opened and closed by the rotating eccentric cam 104.

The rotational position of the valve switching pulley 80, and hence the rotational position of the eccentric cam 104, is detected by the valve switching pulley sensor 81. The rotational position of the eccentric cam 104, and hence the open/close of the first through third valves (101, 102, 103) can be controlled based on the output of the valve switching pulley sensor 81.

It should be noted that a M (magenta) ink motor and a M ink pump driven therewith, and a K (black) ink motor and a K ink pump driven therewith are also mounted to the base plate 32, but not shown in the drawings.

Next, the general configuration of a valve unit 100, which is connected with the wiping unit and the capping unit via tubes, or flow channel, will be described with reference to FIGS. 6A and 6B.

FIG. 6A schematically shows a waste ink discharging channel system of the cleaning device 6 and the valve unit 100 for controlling the flow thereof.

The waste ink discharging channel system includes four sets of first, second and third flow channels and four conventional suction pumps 130 (only one set of the first through third flow channels and the pump 130 is shown). Each of the first flow channel is formed between one of the cap vent 23*a* and one of the pump 130, while each of the third flow channel is formed between one of the absorber vent 37*a* and one of the pump 130. Each second flow channel is connected to one of the cap vent at one end thereof. The other end of each second flow channel is left open to the atmosphere.

The valve unit 100 opens/closes the first through third flow channels and thereby determines through which flow channel the waste ink should flow. The valve unit 100 includes the first valve mechanism 101 for simultaneously opening/closing the four first flow channels, the second valve mechanism 102 for simultaneously opening/closing the four second flow channels, and the third valve mechanism 103 for simultaneously opening/closing the four third flow channels. The valve unit 100 further includes the eccentric cam 104 for driving the first through third valve mechanisms (101, 102, 103), and a housing 105 for accommodating the above mentioned members.

The first, second and third flow channels are formed by first through fifth flexible tubes (111, 112, 113, 114, 116), and first and second joints (115, 117). The first, second and third tubes 111, 112, and 113 are pressed through the first, second and third valve mechanism (101, 102, 103), respectively.

The third tube 113 is connected with the absorber vent 37*a* at one end thereof. The fourth tube 114 is connected with the cap vent 23*a,* and the fifth tube 116 is connected with the pump 130. The fourth tube 114 is also connected with both the first and second tubes 111 and 112 by the first joint 115 that is formed in a Y shape, and the fifth tube 116 is connected with both the first and third tubes 111 and 113 via the second joint 117 that is also formed in Y shape. The end of the second tube 112 that is not connected to the first joint 115 is left open to the atmosphere. The first, fourth, and fifth tubes (111, 114, 116) define the first flow channel. The second and fourth tubes (112, 114) define the second flow channel. Further, the third and fifth tubes (113, 116) define the third flow channel.

Note that a sixth tube 131 is connected to the discharging opening of the pump 130. The waste ink sucked into the pump 130 is discharged therefore through the sixth tube 131 into the waste ink pooling device 8 (see FIG. 1).

FIG. 6B is a top view of the first valve mechanism 101 shown in FIG. 6A. As shown in FIG. 6B, the first valve mechanism 101 includes four valves, i.e., a Y ink valve 120, a C ink valve 121, an M ink valve 122, and a K ink valve 123. Each valve corresponds to different color ink, or respectively cap vents 23*a*. Each valve has the same structure and actuate simultaneously. Further, the second and third valve mechanisms 102 and 103 have the same structure as the first valve mechanism 101. Thus, the structure of only one valve of the first valve mechanism 101 will be described hereinafter and the description of other valves and other valve mechanisms (102, 103) will be omitted.

As shown in FIG. 6A, the first valve mechanism 101 includes a valve block 106, a valve piston 107, a metal shaft 108, and a compression spring 109.

The valve block 106 is provided with a bore into which the valve piston 107 is slidably received. A circular plate having a larger diameter than the valve piston 107 is attached to the bottom of the valve piston 107 to serve as a cam follower 107*c* that follows the periphery of the eccentric cam 104. The compression spring 109 is located between the valve block 106 and the cam follower 107*c*. The compression spring 109 biases the cam follower 107*c* toward the eccentric cam 104.

A first rectangular bore 107*b* is formed to the valve piston 107 to allow the first tube 111, which is made from vinyl resin, passing through the valve piston 107. A second rectangular bore 107*a* is further formed to the valve piston 107 in a direction perpendicular to the first rectangular bore 107*b*. The metal shaft 108 is passed through the second bore 107*a*. Thus, the metal shaft 108 is located adjacent to and perpendicularly to the first tube 111. The metal shaft 108 has a longer dimension than the diameter of the bore formed to the valve block 106. Thus, the metal shaft 108 does not passes through the bore of the valve block 106 even if it is pressed down by the valve piston 107.

The valve piston 107 moves up and down as the eccentric cam 104 rotates. When the valve piston 107 is not moved up by the eccentric cam 104 and is located at its lower position (as shown in the second and third valves mechanism 102 and 103 of FIG. 6A), the metal shaft 108 presses and thereby closes the first tube 111. On the contrary, when the eccentric cam 104 lifts up the valve piston 107 against the biasing force of the compression spring 109, the metal shaft 108 releases the first tube 111. Thus, the first tube 111 opens.

Next, the cleaning process performed by the cleaning device 6 according to the embodiment of the invention will be described with reference to FIGS. 7A through 7C. The cleaning process of the cleaning device 6 includes a purging operation (see FIG. 7A) and a wiping operation (see FIGS. 7B and 7C), which will be carried out after the purging operation.

In the purging operation shown in FIG. 7A, the cap members 23 are lifted up to cover the ink ejecting surface 5*a* of the printhead 5, or cap respective nozzle groups of the printhead 5, as indicated in broken lines in FIG. 7A.

Then, purging of the nozzles is carried out. That is, the C ink motor 89 (see FIG. 5) is driven in reverse direction so that the C ink planet gear 85 engages with the C ink transmission gear 84 and the driving force generated by the C ink motor 89 is transmitted to the eccentric cam 104 via the switching pulleys 80, 83 and the driving belt 82 (see also FIGS. 2 and 6A). The eccentric cam 104 is rotated so as to move up the valve piston 107 of the first valve mechanism 101 against the biasing force of the compression spring 109. As a result, the tube pressing shaft 108 stops passing the first tube 111, and the cap vent 23*a* comes in fluid communication with the pump 130. Then, the pump 130 is actuated to suck out the ink remaining in the nozzles of the printhead 5 and receive it with the cap member 23.

Then, the pump 130 is stopped for a while to allow the ink received in the cap member 23 to flow toward the bottom of the cap member 23.

Then, the C ink motor 89 is driven in the reverse direction again to rotate the eccentric cam 104 to move up the valve piston 107 of the second valve mechanism 102 and thereby open the second tube 112. As a result, the cap vent 23*a* comes in communication with the atmosphere through the second fluid channel. In the meantime, the valve piston at the first valve mechanism 101 is moved down and the first tube 111 is closed.

Then, the cap members 23 is slightly moved down so that a gap is formed between the cap members 23 and the ink ejecting surface 5*a* of the printhead 5. Then, the C ink motor 89 is driven in the reverse direction again so that the valve piston 107 of the first valve mechanism 101 is moved up again. In other words, the first tube 111 is opened while the second tube 112 is closed. Then, the pump 130 is actuated to suck the waste ink within the cap member 23 through the cap vent 23*a*. After a predetermined time, the pump 130 is stopped, or the suction is stopped, and the cap members 23 are moved down to the initial position indicated by solid lines in FIG. 7A.

After the purging operation described above, the wiping operation illustrated in FIGS. 7B and 7C is carried out.

As shown in FIG. 7B in broken lines, the wiping unit is initially located, or waiting, at the initial position (1), which is at the left hand side in FIG. 7B, with the cleaning blade 21 being inclined against the ink ejecting surface 5*a* of the printhead 5 for a predetermine angle. In this state, the side surface of the cleaning blade 21 is in contact with the first absorber 31.

After the purging operation is over, the wiping unit is moved from the initial position (1) to the wiping start position (3) indicated by solid lines in FIG. 7B. During the movement, the wiping unit passes by the printhead 5 as shown in broken lines at position (2), however, the tip portion of the cleaning blade 21 does not come into contact with the ink ejecting surface 5*a* of the printhead 5 since the cleaning blade 21 is inclined and the tip portion thereof is kept at a lower position than the ink ejecting surface 5*a*.

As the wiping unit approaches the wiping start position (3), the bent portion 24*a* of the blade actuating plate 24 abuts against a first protrusion 33 extending upwardly from the top of the base plate 32. The bent portion 24*a* is urged by the first protrusion 33 to move from the rear side to the front side of the opening 25*a* formed to the carriage plate 25 (from right hand side to left hand side in FIG. 7B). Thus, the blade actuating plate 24 moves toward the blade supporting plate 22 and abuts against an abutting portion 22*a* formed at a lower end of the blade supporting plate 22. As a result, the blade supporting plate 22 swings about the supporting pin 27*b* in a clockwise direction in FIG. 7B. When the bent portion 24*a* arrives at the front side (the left hand side in FIG. 7B) of the opening 25*a*, the front side of the blade supporting plate 22, and hence the cleaning blade 21, is located at the upright position thereof (i.e. the cleaning blade 21 is supported perpendicularly to the ink ejecting surface 5*a* of the printhead 5).

The wiping unit is kept at the wiping start position for a predetermined period of time.

Then, as shown in FIG. 7C, the wiping unit moves from the wiping start position (3) toward the initial position (1) with the cleaning blade 21 kept at the upright position thereof. When the wiping unit moves below the printhead 5, as shown in broken lines at position (4), the tip portion of the cleaning blade 21 comes into contact with the ink ejecting surface 5*a* thereof and is warped. The warped tip portion of the cleaning blade 21 is rubbed against the ink ejecting surface 5*a* and thereby wipes the ink off the ink ejecting surface 5*a*.

The wiping unit is once stopped just before the warped tip portion of the cleaning blade 21 comes off from the ink ejecting surface 5*a*, and is moved again after a predetermined period of time. By operating the wiping unit as above, scattering of the ink caused by strong springing back of the warped tip portion of the cleaning blade 21 can be prevented.

The wiping unit is further moved toward the initial position (1). Before the wiping unit arrives at the initial position, the tip portion of the cleaning blade 21 comes into contact with the under surface of the second absorber 30, which is made from felt, nonwoven cloth or the like (see wiping unit illustrated in broken lines at position (5)). Thus, the tip portion of the cleaning blade 21 is rubbed against the second absorber 30 for a predetermined time as the wiping unit approaches the initial position (1) and the ink adhered to the tip portion of the cleaning blade 21 is absorbed or wiped off by the second absorber 30.

As the wiping unit further moves toward the initial position (1), a second protrusion 34 formed to the base plate 32 abuts the bent portion 24*a* of the blade actuating plate 24 and thereby urges the bent portion 24*a* from the front side of the opening 25*a* of the carriage plate 25 to the rear side thereof (from left hand side to right hand side in FIG. 7C). As a result, the blade actuating plate 24, which has been supported the blade supporting plate 22 at the upright position thereof, slides away from the blade supporting plate 22. Thus, the blade supporting plate 22 swings about the supporting pin 27*b* due to the biasing force of the coil spring 17*a*, in counterclockwise direction in FIG. 7C, to locate the cleaning blade 21 to the inclined position thereof.

Finally, the wiping unit arrives at the initial position (1) and the cleaning blade 21 comes into contact with the first absorber 31 at substantially the entire side surface thereof. Thus, the ink adhered to the side surface of the cleaning blade 21 is absorbed by the first absorber 31. Note that the cleaning blade 21 is located above the first absorber 31 so that the ink can be effectively absorbed by the first absorber 31 with the help of gravity.

It should be noted that moving the cleaning blade 21 between the upright and inclined positions thereof does not requires any additional time to the cleaning process. Thus the entire cleaning process can be carried out in a short time. Further, since the movement of the cleaning blade 21 between the upright and inclined positions is caused by the first and second protrusions 33, 34 located in the vicinity of the wiping start position and the initial position of the wiping unit, respectively, the cleaning blade 21 is reliably moved to the required position as the wiping blade approaches the initial or wiping start position, or before the wiping units changes the traveling direction thereof. Thus, the cleaning blade never passes by the recording head with an unexpected attitude.

It should be noted that a part of the under surface of the second absorber 30 is in close contact with the top surface of the first absorber 31. Thus, the ink absorbed by the second absorber 30 gradually moves into the first absorber 31 due to permeate and gravity. Note that although the first and second absorber 31 and 30 are separate members in the present embodiment, they may be also integrally connected to each other.

The ink held in the first absorber 31, and hence the ink in the second absorber 30, is sucked out through the absorber vent 37*a* located adjacent to the lower end of the first absorber 31. That is, the C ink motor 89 is driven in reverse direction to rotate the eccentric cam 104 (see FIG. 6A) until the valve piston 107 of the third valve mechanism 103 is moved up against the biasing force of the compression spring 109. As a result, the metal shaft 108 of the third valve mechanism 103 stops pressing the third tube 113 and allows the absorber vent 37*a* to be in fluid communication with the pump 130 via the third fluid channel. Then, the pump 130 is actuated to remove the waste ink from the first absorber 31 (and also from the second absorber 30) through the absorber vent 37*a* by suction. In this way, the abilities of the first and second absorbers 31, 30 for removing ink form the cleaning blade 21 are maintained irrespective of the times the cleaning process is preformed.

As shown in FIG. 7C, the side surface of the first absorber 31 is covered with the cleaning blade 21 except near the lower end thereof. In other words, the lower end portion of the first absorber 31 that is adjacent to the absorber vent 37*a* is not covered with the cleaning blade 21. Thus, when the pump 130 is actuated to vacuum the waste ink through the absorber vent 37*a*, an air flow is formed that penetrates the first absorber 30 at the lower end portion thereof. Thus, the waste ink that has moved down to the lower end portion of the first absorber 30 due to gravity can be effectively removed.

Next, the carriage 4 is moved above the flushing unit 7 provided at the left side of the ink-jet printer 1 (see FIG. 1), and the printhead 5 starts the preparative discharge (or flushing) of the ink, that is, ink is discharged into the flushing unit 7. Thereafter, the C ink motor 89 is driven in reverse direction to rotate the eccentric cam 104 until the valve piston 107 of the second valve mechanism 102 is moved up against the biasing force of the compression spring 109. As a result, the metal shaft 108 stops pressing the second tube 112 and allows the cap vent 23*a* to be in fluid communication with the atmosphere via the second fluid channel.

Then, the carriage 4 is moved back above the cap members 23 and the cap members 23 cover the ink ejecting surface 5*a* of the printhead 5 again. Further, the C ink motor is driven again in the reverse direction to move the eccentric cam 104 until the valve piston 107 of the third valve mechanism 103 is moved up to open the third tube 113. Thus, the absorber vent 37*a* comes in fluid communication with the pump 130 via the third fluid channel.

Hereinafter, the operation of each of the aforementioned units and the way of changing the unit to be actuated will be described with reference to FIG. 4.

FIG. 4 shows the wiping unit placed at the initial position thereof and the printhead 5 located above the cap members 23. The cap members are located at the lowermost position thereof. The cap members can be moved up to cap the ink ejecting surface 5*a* of the printhead 5. Each of the cap members is provided with the cap vent 23*a* at the bottom thereof for discharging of the waste ink. The cleaning blade 21 of the wiping unit is in contact with the first absorber 31 at the side surface thereof. The top of the first absorber 31 is in close contact with the second absorber 30 that is provided for removing the ink adhered to the tip portion of the cleaning blade 21.

The main driving motor 40 is fixed to the base plate 32. The driving force generated by the main driving motor 40 is transmitted to the main driving planet gear 44 via the main driving motor gear 41, which is provided to the spindle shaft of the main driving motor 40, and the transmission gear 42.

If the main drive switching arm 46 is moved upwards, the main driving planet gear 44 engages with and thereby rotates the pinion gear 45. The pinion gear 45, in turn, moves the rack gear 29 and hence the carriage 26. The direction in which the carriage 26 moves depends on whether the main driving motor is driven in the normal or reverse direction thereof.

On the contrary, if the main drive switching arm 46 is moved downwards, the main driving planet gear 44 engages with the cap gear 43. The driving force generated by the main driving motor 40 is transmitted from the cap gear 43 to the cam rotating gear 52 via the transmission gear 51, which is sharing the rotation axis with the cap gear 43. The eccentric cam 53 is fixed to the rotation axis of the cam rotating gear 52. Thus, eccentric cam 53 integrally rotates with the cam rotating gear 52. As the eccentric cam 53 rotates, the cam follower 56 moves up and down by following the periphery of the eccentric cam 53. As a result, the cap supporting rod 54 coupled to the cam follower 56 at one end thereof, the cap supporting member 55 attached at the other end of the cam supporting rod 54, and the camp members 23 mounted on the cap supporting member 55 move up and down.

In the present embodiment, the cap members 23 move up to cap the ink ejecting surface 5*a* when the main driving motor 40 rotates in one direction, and move down or move away from the ink ejecting surface 5*a* if the main driving motor 40 rotates in the other direction. The current position of the cap members 23 can be determined based on the output of a sensor (not shown) that detects the rotational position of the cam rotating gear 52.

Next, the mechanism and operation of moving up and down the main drive switching arm 46 will be described with reference to FIGS. 4 and 5.

As shown in FIG. 5, the Y ink motor 69 is mounted to the base plate 32 at the inner side thereof. The Y ink motor gear 66 is fixed to the spindle shaft of the Y ink motor 69. The Y ink switching arm 67 is pivotably mounted to the spindle shaft of the Y ink motor 69 so as to be swingable right and left. The Y ink plant gear 65 is rotatably supported by the Y ink switching arm 67. The Y ink planet gear 65 is also engaged with the Y ink motor gear 66.

If the Y ink motor 69 rotates in normal direction, the Y ink switching arm 67 swings in clockwise direction in FIG. 5. As a result, the Y ink planet gear 65 engages with and thereby transmits the driving force generated by the Y ink motor 69 to the Y ink pump gear 68 so that the Y ink pump (not shown) actuates.

On the contrary, if the Y ink motor 69 rotates in reverse direction, the Y ink switching arm 67 swings in counter-clockwise direction and the Y ink planet gear 65 engages with the Y ink transmission gear 64. As a result, the driving force from the Y ink motor 69 is transmitted to the Y ink transmission pulley 63, which shares the rotation axis with the Y in transmission gear 64, the Y ink belt 62, the main drive switching pulley 60 (see FIG. 4), and finally to the eccentric cam 50. As the eccentric cam 50 rotates, the main drive switching arm 46 moves up and down. Thus, one of the wiping unit and the capping unit can be selectively operated.

Note that the rotational position of the eccentric cam 50 is detected by the main drive switching pulley sensor 61 (see FIG. 2) and utilized to control the rotation of the eccentric cam 50.

Next, the mechanism an operation of selectively opening/closing one of the valve mechanism of the valve unit 100 will be described with reference to FIGS. 5, 6A and 6B.

As shown in FIG. 5, the C ink motor 89 is mounted to the base plate 32 at the inner side thereof. The C ink motor gear 86 is fixed to the spindle shaft of the C ink motor 89. The C ink switching arm 87 is pivotably mounted to the spindle shaft of the C ink motor 89 so as to be swingable right and left. The C ink planet gear 85 is rotatably supported by the C ink switching arm 87 and engaged with the C ink motor gear 86.

If the C ink motor 89 rotates in normal direction, the C ink switching arm 87 swings in clockwise direction so that the C ink planet gear 85 engages with the C ink pump gear 88. Thus, the C ink pump is actuated by the driving force from the C ink motor 89.

On the contrary, if the C ink motor 89 is driven in the reverse direction, the C ink switching arm 87 swings in counterclockwise direction so that the C ink planet gear 85 engages with the C ink transmission gear 84. As a result, the driving force from the C ink motor 89 is transmitted to the C ink transmission pulley 83, which shares the rotation axis with the C ink transmission gear 84, the valve driving belt 82, the valve switching pulley 80 (FIG. 2), and finally to the eccentric cam 104 (FIG. 6B). The eccentric cam 104, provided with the driving force, rotates and thereby opens/closes the first through third valve mechanisms 101, 102, 103 in sequence. In other words, while one valve mechanism is opened, the other two valve mechanisms are closed without exception.

It should be noted that the rotational position of the eccentric cam 104 is detected by the valve switching pulley sensor 81. The rotation of the eccentric cam 104 is controlled based on the detection of the valve switching pulley sensor 81 such that the eccentric cam 104 stops rotating when the required valve mechanism is open.

Next, the operation of the whole cleaning device will be described with reference to FIG. 8.

FIG. 8 is a timing chart of the general operation of the cleaning device 6 according to the embodiment of the invention. The vertical axis of FIG. 8 indicates whether each of motors (main driving motor 40, Y ink motor 69, C ink motor 89, M ink motor, K ink motor) is under suspension or rotating in normal or reverse direction. The vertical axis also indicates the occurrence of the preparative discharging of the ink, and the position (up/down) of the cap members 23. The horizontal axis indicates, in sequence, the events (T1 through T19) that occur during the operation of the cleaning device 6. Note that the intervals between the events in the horizontal axis do not correspond to the actual time intervals between the events.

After a printing operation is carried out, the printhead 5 moves from a printing zone to a location above the cleaning device 6, which is generally called home position or maintenance position. At the home position, the ink ejecting surface of the printhead 5 is normally covered with the cap members 23 to prevent drying of the printhead 5. The cleaning of the printhead 5 is required when the printhead 5 is located at the home position with the ink ejecting surface being covered with the cap members 23, e.g. just after the power of the printer 1 is turned on. When the cleaning is required, the cleaning device 6 starts to operate as illustrated in FIG. 8.

First, the C ink motor 89 is reversely rotated to open the first valve mechanism 101 and connect the cap vents 23*a* of the cap members 23, each corresponding to different color ink, with the respective one of the four pumps 130 (T1).

Next, each of the Y, C, M, and K ink motors is driven in normal direction to actuate the corresponding pump 130 and suck out the ink from the nozzles of the printhead 5 through each cap member 23 for a predetermined time (T2). In this way, dirt that may cause clogging of the nozzle is removed.

Then, each pump 130 is stopped for a predetermined time (T3) to allow the ink received in each cap member 23 to flow along the inner wall thereof, which is formed in a funnel like shape, toward the bottom or the lowest location of each cap member 23.

At T4, the C ink motor 89 is reversely rotated to open the second valve mechanism 102 and allow the cap vent 23*a* of each cap member 23 to come in fluid communication with the atmosphere.

Next, the main driving motor 40 is reversely driven to rotate the eccentric cam 53 such that the cap members 23 are slightly moved down and a gap is formed between the cap members 23 and the printhead 5 (T5). It should be noted that the pressure within the cap members 23 is kept constant during this step since the cap vent 23*a* is in fluid communication with the atmosphere, and the pressure within the cap members 23 does not decrease as the cap members 23 is detached from the printhead 5. Therefore, the cap members 23 can be easily detached from the ink ejecting surface 5*a* of the printhead 5. Further, the ink within the nozzles of the printhead 5 will be not sucked out as the cap members 23 moves away from the printhead 5.

Next, the C ink motor 89 is reversely rotated to drive the eccentric cam 104 until the first valve mechanism 101 is opened so that the cap vent 23*a* of each cap members 23 is connected to the corresponding pump 130 again (T6).

Then, each of the Y, C, M, and K ink motors is driven in normal direction to actuate the respective pump 130 (T7) and thereby suck out the ink remaining in each the cap member 23.

At T8, the main driving motor 40 is driven again in the reverse direction to move the cap members 23 down to the lowest position thereof.

Next, the Y ink motor 69 is driven in reverse direction to rotate the eccentric cam 50 and thereby swing the main drive switching arm 46 upwards (T9). As a result, the main driving planet gear 44 engages with the pinion gear 45 and the carriage 26, and hence the wiping unit, becomes the move right and left in accordance with the rotation of the main driving motor 40.

At T10, the main driving motor 40 is driven in normal direction so that the wiping unit moves from the initial position thereof to the wiping start position (see also FIG. 7B). During this step, the cleaning blade 21 is kept at the inclined position thereof as described in connection with FIG. 7B. Therefore, the cleaning blade 21 passes by the printhead 5 without coming into contact with the ink ejecting surface 5*a*. Further, as is also described in connection with FIG. 7B, the cleaning blade 21 is moved to the upright position thereof as the wiping unit approaches the wiping start position.

At T11 and T12, the main driving motor 40 is reversely rotated to move the carriage 26 from the wiping start position to the initial position thereof. Since the cleaning blade 21 is held at the upright position thereof, the tip portion of the cleaning blade 21 is rubbed against the ink ejecting surface 5*a* of the printhead 5 when the wiping unit passes by the printhead 5, and thereby wipes the ink ejecting surface 5*a* clean.

It should be noted that the wiping unit is once stopped just before the cleaning blade 21 comes off the ink ejecting surface 5*a* (see the transition period between step T11 and T12) to prevent scattering of the ink caused by the springing back of the warped tip portion of the cleaning blade 21 as the cleaning blade 21 is released from the ink ejecting surface 5*a*.

Then, the wiping unit is restarted to move toward the initial position thereof (T12). This time, the wiping unit moves below the second absorber 30 with the tip portion of the cleaning blade 21 being rubbed against the under surface of the second absorber 30. Further, as the wiping unit approaches the initial position, the cleaning blade 21 is moved to the inclined position thereof so that the front surface of the cleaning blade 21 comes into contact with the first absorber 31 when the wiping unit is stopped at the initial position.

At T13, the C ink motor 89 is reversely rotated to open the third valve mechanism 103 and thereby connect the absorber vent 37*a* with the pump 130.

At T14, the main drive switching arm 46 is swung down by rotating the Y ink motor in reverse direction so that the main driving planet gear 44 engages with the transmission gear 51. Thus, if the main driving motor 40 is driven, the eccentric cam 53 rotates and the cap members 23 move up and down.

At T15, all of the Y, C, M, and K ink motors are driven in normal direction to suck the ink from the first and second absorbers 31, 30 through the absorber vent 37*a*.

At T16, the C ink motor 89 is reversely rotated to open the second valve mechanism 102. Thus, the cap vents 23*a* come in fluid communication with the atmosphere through the second fluid channel.

In the mean time, the printhead 5 is moved above the flushing unit 7, and the preparative discharge of ink is carried out (T16). This preparative discharge is carried out to discharge the dust pushed into the nozzle by the cleaning blade 21 during the wiping operation at T11 and thereby prevent clogging of the nozzles due to such dust. After the preparative discharge, the printhead 5 moves back above the cap members 23.

At T17, the main driving motor 40 rotates in normal direction to move the cap members 23 to the uppermost position thereof, i.e., to the location where the cap members 23 cover the ink ejecting surface 5*a* of the printhead 5. It should be noted that the pressure within the cap members 23 is kept constant during this step since the cap vent 23*a* is in fluid communication with the atmosphere, and the pressure within the cap members 23 does not increases as the cap members 23 is pressed against the printhead 5. Therefore, the cap members 23 can be easily attached to the ink ejecting surface 5*a* of the printhead 5. Further, the ink within the nozzles of the printhead 5 will be not pushed back into the printhead 5 as the cap members 23 cover the ink ejecting surface 5*a*.

At T18, the C ink motor rotates in reverse direction to open the third valve mechanism 103. Thus, the absorber vent 37*a* comes in fluid communication with the pump 130 via the third fluid channel.

Then, the cleaning device stands ready to the next cleaning operation (T19).

As described above, in the cleaning device 6 according to the embodiment, the pump 130 is used for both sucking ink from the cap member 23 and from the first ink absorber 31. Thus, it is not necessary to provide the cleaning device 6 with a large number of suction pumps. Further, the pump 130 is used for sucking ink from only one of the cap member 23 and the first ink absorber 31 at one time. Thus, it is not necessary to provide the cleaning device with a high power pump.

FIGS. 9A through 9C illustrate a variation of the cleaning process performed by the cleaning device 6 according to the embodiment of the invention. In this variation, the wiping unit is first located at the initial position (1) with the cleaning blade 21 located at the inclined position thereof (FIG. 9A). Then the wiping unit moves to the wiping start position (3). Since the cleaning blade 21 is kept at the inclined position thereof, the tip portion of the cleaning blade 21 does not come into contact with the ink ejecting surface 5*a* when the wiping unit passes by the printhead 5 (see the broken lines at position (2) in FIG. 9).

After arriving at the wiping start position, the wiping unit is stopped thereat with the cleaning blade 21 placed at the upright position thereof, as shown in solid lines in FIG. 9B. In the meantime, the cap members 23 moves up to cover the ink ejecting surface 5*a* of the printhead 5 as shown in broken lines in FIG. 9B and the purging operation described in connection with FIG. 7A is carried out. After the purging operation is finished, the cap members 23 moves down to the lowermost position thereof, as shown in solid lines in FIG. 9B, to make way for the wiping unit.

Next, the wiping unit moves back toward the initial position (1) with the cleaning blade 21 kept at the upright position thereof. When the wiping unit passes by the printhead 5, the tip portion of the cleaning blade 21 is rubbed against the ink ejecting surface 5*a* and thereby wipes off the ink ejecting surface 5*a* (see the broken line at position (4) in FIG. 9C).

It should be noted that the wiping unit is stopped for a while just before the cleaning blade 21 comes off the ink ejecting surface 5*a* to prevent the scattering of the ink due to the strong spring back of the warped tip of the cleaning blade 21.

After the wiping unit restarts and moves below the second absorber 30 toward the initial position (1) (see the broken lines at position (5) in FIG. 9C). The tip portion of the cleaning head is rubbed against the under surface of the second absorber 30 since the cleaning blade 21 is held at the upright position thereof. Thus, the ink adhered to the tip portion of the cleaning blade 21 is removed by the second absorber 30.

Shortly before the wiping unit arrives at the initial position (1), the cleaning blade 21 is turned to the inclined position thereof. Thus, when the wiping unit is located at the initial position (1), the cleaning blade 21 comes into contact with the first absorber 31 at substantially the entire side surface thereof, as shown in solid lines in FIG. 9C, and the ink adhered to the cleaning blade 21 will be absorbed by the first absorber 31.

FIG. 10 is a timing chart of the operation of the cleaning device that performs the cleaning process in a manner as shown in FIGS. 9A through 9C. The timing chart shown in FIG. 10 is substantially the same as that illustrated in FIG. 8 except the following two points. The first difference is that step T10 is canceled. The second difference is that additional steps T31 through T37 are performed before step T1.

Thus, cleaning process shown in FIG. 10 initiates with reversely rotating the C ink motor 89 to open the second valve mechanism 102 and allow the cap vent 23*a* of each cap member 23 to come in fluid communication with the atmosphere.

Then, the main driving motor 40 is reversely driven to rotate the eccentric cam 53 such that the cap members 23 are moved down to the lowermost position thereof (T32).

Next, the Y ink motor 69 is driven in reverse direction to rotate the eccentric cam 50 and thereby swing the main drive switching arm 46 upwards (T33). Thus, the main driving planet gear 44 engages with the pinion gear 45. In this way, the carriage 26, and hence the wiping unit, becomes to move right and left in accordance with the rotation of the main driving motor 40.

At T34, the carriage 26, and hence the cleaning blade 21 is moved from the initial position to the wiping start position. This is achieved by driving the main driving motor 40 in normal direction. It should be noted that the cleaning blade 21 is kept at the inclined position thereof during this step. It should be also noted that the cleaning blade 21 is moved to the upright position thereof as the wiping unit approaches the wiping start position.

Then, the main driving motor 40 rotates in normal direction to move the cap members 23 to the uppermost position thereof, i.e., to the location where the cap members 23 come into close contact the ink ejecting surface 5*a* of the printhead 5 (T36).

After step T37, steps T1 through T9 and steps T11 and T19 are carried out in sequence. The detailed descriptions of these steps, however, will be omitted since they are already described in connection with FIG. 8.

FIGS. 11A through 11C illustrate another variation of the cleaning process performed by the cleaning device 6 according to the embodiment of the invention.

In this variation, the wiping unit is first located at the rearmost position thereof or the wiping start position (11), as shown in FIG. 11A. Note that the cleaning blade 21 is at the upright position thereof at this state.

While having the wiping unit at the wiping start position (11), the cap members 23 moves up to cover the ink ejecting surface 5*a* of the printhead 5 as shown in broken lines in FIG. 11A and the purging operation described in connection with FIG. 7A is carried out. After the purging operation is finished, the cap members 23 moves down to the lowermost position thereof, as indicated in solid lines in FIG. 11A, to make way for the wiping unit.

Next, the wiping unit moves toward the first absorber 31, or a wiping end position, with the cleaning blade 21 kept at the upright position thereof (see FIG. 11B). Thus, when the wiping unit passes by the printhead 5, the tip portion of the cleaning blade 21 is rubbed against the ink ejecting surface 5*a* and wipes off the ink ejecting surface 5*a* (see the broken line at position (12) in FIG. 11B).

The wiping unit stops for a predetermined time just before the cleaning blade 21 comes off the ink ejecting surface 5*a* to prevent the scattering of ink due to the spring back of the cleaning blade 21.

Then the wiping unit restarts and moves below the second absorber 30 with the tip portion of the cleaning head 21 being rubbed against the second absorber 30 (see the broken line at position (13) in FIG. 11B.

Then, the wiping unit arrives at the first absorber 31 or the wiping end position (see the solid line at position (14) in FIG. 11B). At the wiping end position, the cleaning blade 21 is located at the inclined position thereof so that substantially the entire side surface thereof abuts against the first absorber 31. The wiping unit is kept at the position (14) for a while to allow the ink on the cleaning blade 21 to be removed by the first absorber 31. Then, the wiping unit returns to the wiping start position (11) as shown in FIG. 11C. On the way back to the wiping start position, the cleaning blade 21 is kept at the inclined position. Therefore, the cleaning blade 21 does not come into contact with the ink ejecting surface 5*a* when the wiping unit passes by the printhead 5.

The cleaning blade 21 is returned to the upright position thereof as the wiping unit approaches the wiping start position (11), and the wiping unit stands ready to the next cleaning process at the wiping starting position (11) with the cleaning blade 21 at the upright position as indicated in solid lines in FIG. 11C.

FIG. 12 is a timing chart of the operation of the cleaning device that performs the cleaning process in a manner as shown in FIGS. 11A through 11C. The timing chart shown in FIG. 12 is substantially the same as that illustrated in FIG. 8 except that step 10 is moved from between steps T9 and T11 to between steps T14 and T15. Thus, detailed description of the timing chart shown in FIG. 12 will be omitted.

While the invention has been described in connection with a specific exemplary embodiment thereof, it should be understood that the invention is not limited to the above-described exemplary embodiment.

For example, the ink remaining on the ink ejecting surface may be wiped off by moving the printhead 5 while keeping the cleaning blade 21 stationary instead of moving the cleaning blade 21 relative to the unmoving printhead 5 as in the above described embodiment. In this case, the wiping unit is configured such that the blade actuating plate 24 moves toward/away from the blade supporting plate 22 in accordance with the movement of the printhead 5 so that the cleaning blade 21 moves between the inclined position and the upright position thereof in a suitable timing. To be more specific, the cleaning blade 21 is kept at the inclined position thereof, while the printhead 5 moves towards a wiping start position, so that the tip portion of the cleaning blade 21 does not come into contact with the ink ejecting surface 5*a* of the printhead 5. Then, when the printhead 5 has arrived at the wiping start position, the blade actuating plate 24 slides under the blade supporting plate 22. As a result, the cleaning blade 21 is moved to the upright position thereof where the tip portion is located high enough to become into contact with the ink ejecting surface 5*a* of the printhead 5. Then, the printhead 5 moves in opposite direction so that the tip portion of the cleaning blade 21 wipes across the ink ejecting surface 5*a* and thereby removes the ink remaining thereon. The blade actuating plate 24 slides away from the blade supporting plate 22 after the wiping has finished, or after the printhead 5 has come off the cleaning blade 21, in order to bring back the cleaning blade 21 to the inclined position thereof.

It should be noted that, also in the above mentioned case, an ink absorber such as the first absorber 31 may be provided adjacent to the cleaning blade 21 so as to come into contact with the cleaning blade 21 when it is located at the inclined position in order to remove the ink adhered thereto.

In the embodiment according to the invention, the wiping unit is moved so that the cleaning blade 21 wipes off the ink ejecting surface 5*a*. The wiping unit is stopped for a while just before the cleaning blade 21 comes off the ink ejecting surface 5*a*. Then the wiping unit started to move at the same speed as before. The wiping unit is stopped and restarted as above in order to prevent the scattering of ink caused by the spring back of the warped tip portion of the cleaning blade 21 at the moment when the cleaning blade 21 comes off the ink ejecting surface 5*a*.

It should be noted that the traveling speed of the wiping unit after the restart may be controlled to be slower than before by changing the driving condition of the main driving motor 40, such as by decreasing the voltage applied thereto or, if the main driving motor 40 is a step motor, by providing less driving pulses to the step motor. The amount of scattered ink decreases as the traveling speed of the wiping unit after the restart decreases. The decrease in the traveling speed of the wiping unit also allows the second absorber 30 to absorb the ink adhered on the tip portion of the cleaning blade 21 in addition to merely wiping off the tip portion. However, since the time required for cleaning should be as short as possible, the traveling speed of the wiping unit after the restart should be determined as fast as possible (as long as the second absorber can satisfactorily remove the ink from the cleaning blade 21) by taking into account the ink absorbing ability of the second absorber 30.

The present disclosure relates to the subject matters contained in Japanese Patent Applications Nos. P2002-118218 and P2002-118219, both filed on Apr. 19, 2002, which are expressly incorporated herein by reference in their entireties.

What is claimed is:

1. A cleaning device for cleaning a printhead of an ink-jet printer, comprising:

a cleaning unit provided with a cleaning blade; and a traveling unit that carries said cleaning unit, said traveling unit reciprocating to perform a cleaning cycle of the printhead, wherein said cleaning blade is held by said cleaning unit perpendicular to an ink ejecting surface of the printhead to clean said ink ejecting surface when said traveling unit moves in one direction, and wherein said cleaning blade is inclined against said ink ejecting surface to avoid being rubbed against said ink ejecting surface when said traveling unit moves in an opposite direction.

2. The cleaning device according to claim 1, wherein said traveling unit reciprocates between first and second positions, said first position being a standby position at which said cleaning unit is a in standby state with said cleaning blade inclined against said ink ejecting surface, and wherein said cleaning unit locates said cleaning blade perpendicular to said ink ejecting surface shortly before arriving at said second position and changing the direction of traveling, passes by and cleans said ink ejecting surface by rubbing said ink ejecting surface with a tip portion of said cleaning blade held perpendicular to said ink ejecting surface, inclines said cleaning blade against said ink ejecting surface shortly before arriving at said first position, and stays at said first position.

3. The cleaning device according to claim 2, wherein said traveling unit temporarily stops moving said cleaning unit shortly before said cleaning blade comes off from said ink ejecting surface after having cleaned said ink ejecting surface, and restarts moving said cleaning unit.

4. The cleaning device according to claim 1, wherein said traveling unit reciprocates between first and second positions, wherein said first position is a standby position at which said cleaning unit is in a standby state with said cleaning blade held perpendicular to said ink ejecting surface, and wherein said cleaning unit passes by and cleans said ink ejecting surface by rubbing said ink ejecting surface with a tip portion of said cleaning blade held perpendicular to said ink ejecting surface, inclines said cleaning blade against said ink ejecting surface shortly before arriving at said second position and changing the direction of traveling, passes by said ink ejecting surface with said cleaning blade being inclined so as to avoid said cleaning blade from being rubbed against said ink ejecting surface, locates said cleaning blade perpendicular to said ink ejecting surface shortly before arriving at said first position, and stays at said first position.

5. The cleaning device according to claim 4, wherein said traveling unit temporarily stops moving said cleaning unit shortly before said cleaning blade comes off from said ink ejecting surface after having cleaned said ink ejecting surface, and restarts moving said cleaning unit.

6. The cleaning device according to claim 1, wherein said traveling unit reciprocates between first and second positions, wherein said first position is a first standby position at which said cleaning unit is in a standby state with said cleaning blade inclined against said ink ejecting surface, and wherein said second position is a second standby position at which said cleaning unit is in a standby state with said cleaning blade being perpendicular to said ink ejecting surface, and wherein said cleaning unit locates said cleaning blade perpendicular to said ink ejecting surface shortly before arriving at said second position, stays at said second position, moves from said second position toward said first position, passes by and cleans said ink ejecting surface by rubbing said ink ejecting surface with a tip portion of said cleaning blade held perpendicular to said ink ejecting surface, inclines said cleaning blade against said ink ejecting surface shortly before arriving at said first position, and stays at said first position.

7. The cleaning device according to claim 6, wherein said traveling unit temporarily stops moving said cleaning unit shortly before said cleaning blade comes off from said ink ejecting surface after having cleaned said ink ejecting surface, and restarts moving said cleaning unit.

8. The cleaning device according to claim 1, wherein said cleaning unit includes:

a guide shaft fixed to a base plate of said cleaning device;

a carriage slidably mounted to said guide shaft to reciprocated along said guide shaft;

a carriage plate fixed to said carriage to integrally move with said carriage;

a blade supporting plate that supports said cleaning blade;

a bracket fixed to said carriage plate, said bracket pivotably supporting said blade supporting plate so as to allow said blade supporting plate to swing for a predetermined angle about an axis perpendicular to a traveling direction of said carriage; and a blade actuating plate supported by said carriage plate so as to be swingable for a predetermined angle, said blade actuating plate being moved in a first direction to abut and thereby locate said blade supporting plate perpendicular to said ink ejecting surface, said blade actuating plate being moved in a second direction to move away and thereby allow said blade supporting plate to incline.

9. The cleaning device according to claim 8, wherein said base plate is provided with first and second protrusions, and wherein said blade actuating plate is pushed by said first and second protrusions to move in said first and second directions, respectively, as said carriage reciprocates.

10. The cleaning device according to claim 1, wherein said traveling unit includes:

a guide shaft fixed to a base plate of said cleaning device;

a carriage slidably mounted to said guide shaft to reciprocated along said guide shaft;

a rack gear fixed to said carriage;

a pinion gear engaged with said rack gear to transmit driving force thereto; and a driving unit fix to said base plate, said driving unit rotates said pinion gear in normal and reverse direction.

11. The cleaning device according to claim 1, further comprising, an ink absorber that removes ink adhered to said cleaning blade after having cleaned the printhead, said ink absorber and said cleaning blade being separate from each other.

12. The cleaning device according to claim 11, wherein said ink absorber includes:

a first absorber portion arranged to remove ink from a tip portion of said cleaning blade; and a second absorber portion arranged to remove ink from a side surface of said cleaning blade.

13. The cleaning device according to claim 12, wherein said first absorber portion is arranged such that said tip portion of said cleaning blade is rubbed against said first absorber portion for a predetermined time period during the reciprocation of said traveling unit, said first absorber portion removes ink from said tip portion of said cleaning blade when said tip portion is rubbed against said first absorber portion.

14. The cleaning device according to claim 12, wherein said traveling unit reciprocates between first and second positions, and wherein said second absorber portion is arranged so as to come in close contact with substantially the entire side surface of said cleaning blade when said cleaning blade is inclined against said ink ejecting surface at said first position.

15. The cleaning device according to claim 14, wherein said cleaning blade is above said second absorber portion when said cleaning blade is in contact with said second absorber portion.

16. The cleaning device according to claim 12, wherein said first absorber portion is in contact with said second absorber portion so as to allow ink in said first absorber portion to infiltrate into said second absorber portion.

17. The cleaning device according to claim 16, wherein said first and second absorber portions are integrally formed into a single member.

18. The cleaning device according to claim 12, further comprising an absorber vent provided in a vicinity of a lower end portion of said second absorber portion, said absorber vent facing a side of said second absorber portion opposite to said side coming into contact with said cleaning blade, said absorber vent allowing ink in said second absorber portion to be discharged.

19. The cleaning device according to claim 18, further comprising a pump connected to said absorber vent to vacuum ink from said second absorber portion through said absorber vent.

20. The cleaning device according to claim 19, further comprising an ink discharging flow path extending from said first absorber portion to said absorber vent through said second absorber portion.

21. The cleaning device according to claim 18, further comprising:

a cap member arranged to cover at least a portion of said ink ejecting surface and receive ink discharged from the printhead, said cap member being provided with a cap vent for discharging ink received in said cap member; and a suction device connected with both of said cap vent and said absorber vent so as to be in fluid communication with said cap vent and said absorber vent, said suction device removing ink from said cap member and said second absorber portion through said cap vent and said absorber vent, respectively, by suction.

22. The cleaning device according to claim 21, wherein said suction devices includes:

a pump;

a cap flow channel extending between said cap vent and said pump;

an absorber flow channel extending between said absorber vent and said pump; and a switching system that selectively bring one of said cap flow channel and said absorber flow channel in fluid communication with said pump.

23. The cleaning device according to claim 22, wherein each of said cap flow channel and said absorber flow channel is formed from a flexible tube, and wherein said switching system includes:

a cap valve that closes/opens said cap flow channel by pressing/releasing said cap flow channel;

an absorber valve that closes/opens said absorber flow channel by pressing/releasing said absorber flow channel; and an eccentric cam that drives said cap valve and said absorber valve to selectively open one of said cap flow channel and said absorber flow channel.

24. The cleaning device according to claim 23, wherein said suction device further includes a discharge flow channel connected with said cap vent at one end thereof and opened to atmosphere at other end thereof.

25. The cleaning device according to claim 24, wherein said discharge flow channel is formed from a flexible tube, and wherein said switching system further includes:

a discharge valve that closes/opens said discharge flow channel by pressing/releasing said discharge flow channel, and wherein said eccentric cam drives said cap valve, said absorber valve, and said discharge valve to selectively open one of said cap flow channel, said absorber flow channel, and said discharge flow channel.

26. The cleaning device according to claim 25, further comprising a cap moving mechanism that moves said cap member toward and away from said ink ejecting surface, and wherein said discharge flow channel is opened during said cap member is moved toward and away from said ink ejecting surface.

27. A cleaning device for cleaning an ink ejecting surface of an ink-jet printhead, comprising:

a cleaning blade arranged to wipe said ink ejecting surface with a tip portion thereof;

a blade supporting member arranged to support said cleaning blade, said blade supporting member being movable between first and second blade positions, said cleaning blade comes into contact with said ink ejecting surface to wipe said ink ejecting surface at said first blade position while being kept apart from said ink ejecting surface at said second blade position;

a first ink absorber having a side surface being inclined against said ink ejecting surface, said side surface coming into contact with said cleaning blade located at said second blade position to remove ink adhered to said cleaning blade; and a carriage arranged to carry said blade supporting member between a wiping start position and a wiping end position, wherein said blade supporting member keeps said cleaning blade at said first blade position when said carriage moves from said wiping start position to said wiping end position to allow said cleaning blade wiping said ink ejecting surface of the printhead, and wherein said blade supporting member keeps said cleaning blade at said second blade position when said carriage moves from said wiping end position to said wiping start position to prevent said cleaning blade from coming into contact with said ink ejecting surface.

28. The cleaning device according to claim 27, wherein said blade supporting member is supported pivotably about an axis parallel to said ink ejecting surface, and wherein said blade supporting member swings toward said ink ejecting surface to locate said cleaning blade at said first blade position and swings away from said ink ejecting surface to locate said cleaning blade at said second blade position.

29. The cleaning device according to claim 28, further comprising a blade actuating member placed adjacent to said blade supporting member, said blade actuating member being movable toward and away from said blade supporting member, said blade actuating member make said blade supporting member to swing to said first blade position by moving toward and sliding under said blade supporting member, said blade actuating member allowing said blade supporting member to swing to said second blade position by moving away from said blade supporting member.

30. The cleaning device according to claim 28, wherein said cleaning blade is perpendicular to said ink ejecting surface at said first blade position and inclined against said ink ejecting surface at said second blade position.

31. The cleaning device according to claim 27, wherein said cleaning blade is located above said first ink absorber at said second blade position.

32. The cleaning device according to claim 27, wherein said cleaning blade located at said second blade position contacts with said first ink absorber at substantially the entire side surface of said cleaning blade.

33. The cleaning device according to claim 27, further comprising:

a guide shaft arranged substantially in parallel with said ink ejecting surface of the printhead, said carriage moving between said wiping start position and said wiping end position along said guide shaft;

a rack gear fixed to said carriage;

a gear mechanism engaged with said rack gear; and a motor coupled to said gear mechanism to drive said carriage between said wiping start position and said wiping end position along said guide shaft.

34. The cleaning device according to claim 27, further comprising:

a blade actuating member placed adjacent to said blade supporting member movably toward and away from said blade supporting member;

a first abutting member arranged to abut against and thereby move said blade actuating member toward said blade supporting member as said carriage approaches said wiping start position; and a second abutting member arranged to abut against and thereby move said blade actuating member away from said blade supporting member as said carriage approaches said wiping end position, wherein said blade supporting member is supported pivotably about an axis parallel to said ink ejecting surface, and wherein said blade actuating member make said blade supporting member to wing to said first blade position when moved toward said blade supporting member and allows said blade supporting member to swing to said second blade position when moved away from said blade supporting member.

35. The cleaning device according to claim 34, wherein said first and second abutting member are located adjacent to said wiping start position and said wiping end position, respectively.

36. The cleaning device according to claim 34, further comprising:

a carriage plate mounted on said carriage substantially in parallel with said ink ejecting surface of said printhead; and a bracket fixed to said carriage plate with a mounting portion thereof being arranged perpendicularly to said ink ejecting surface, wherein said blade supporting member is pivotably mounted to said mounting portion of said bracket so as to be swingable between said first and second blade positions, and wherein said blade actuating member is pivotably mounted on said carriage plate so as to be slidable over said carriage plate toward and away from said blade supporting member.

37. The cleaning device according to claim 36, wherein said carriage plate is provided with an opening, and wherein said blade actuating member has a protrusion, said protrusion penetrating said opening, said first and second abutting members coming into contact with said blade actuating member at said protrusion and moving said protrusion between two opposing sides of said opening.

38. The cleaning device according to claim 27, further comprising a second ink absorber arranged between said printhead and said wiping end position so as to come into contact with said tip portion of said cleaning blade passing by said second ink absorber while being kept at said first blade position.

39. The cleaning device according to claim 38, wherein said second ink absorber is located adjacent to said first ink absorber, and wherein said tip portion of said cleaning blade is rubbed against said second ink absorber when approaching said wiping end position.

40. The cleaning device according to claim 38, wherein a portion of said second ink absorber is in contact with said first ink absorber.

41. The cleaning device according to claim 40, wherein said second ink absorber is integrally formed to said first ink absorber.

42. The cleaning device according to claim 27, further comprising an absorber vent formed in a vicinity of a lower end portion of said first ink absorber at a side opposite to a side surface coming into contact with said cleaning blade, ink absorbed into said first ink absorber being discharged through said absorber vent.

43. The cleaning device according to claim 42, further comprising a suction pump connected to said absorber vent to discharge ink from said first ink absorber under suction.

44. The cleaning device according to claim 43, wherein said cleaning blade comes into contact with said first ink absorber at a portion other than said lower end portion of said first ink absorber.

45. The cleaning device according to claim 42, further comprising:

a cap member arranged to cover at least a part of said ink ejecting surface and receive ink discharged from said ink ejecting surface, said cap member being provided with a cap vent for discharging said ink received in said cap member;

a single suction pump; and a connecting mechanism that selectively connects one of said cap vent and said absorber vent with said single suction pump.

46. The cleaning device according to claim 45, wherein said connecting mechanism includes:

a first suction tube connected to said cap vent at one end thereof;

a second suction tube connected to said absorber vent at one end thereof;

a pump tube connected to said pump at one end thereof and to said first and second suction tubes at other end thereof; and a valve system provided to said first and second suction tubes to selectively open and close said first and second suction tubes.

47. The cleaning device according to claim 46, wherein said valve system includes:

first and second suction tube valves provided to said first and second suction tube, respectively; and a valve actuator that selectively opens one of said first and second suction tube valves.

48. The cleaning device according to claim 47, wherein said valve actuator includes an eccentric cam that actuates said first and second suction tube valves at different timing.

49. The cleaning device according to claim 45, wherein said connecting mechanism includes:

a first flow channel connected to said cap vent at one end thereof and said pump at other end thereof;

a first valve mechanism provided to said first flow channel to open and close said first flow channel;

a second flow channel connected to said cap vent at one end thereof and opened to atmosphere at other end thereof;

a second valve mechanism provided to said second flow channel to open and close said second flow channel;

a third flow channel connected to said absorber vent at one end thereof and said pump at other end thereof;

a third valve mechanism provided to said third flow channel to open and close said third flow channel; and a valve actuator that selectively opens one of said first through third valve mechanisms.

50. The cleaning device according to claim 49, wherein said cap member moves toward and away from said printhead to cover and uncover said ink ejecting surface, and wherein said valve actuator opens said second valve when said cap member moves toward or away from said ink ejecting surface.

51. The cleaning device according to claim 27, further comprising:

a cap member arranged to cover at least a part of said ink ejecting surface of said printhead and receive ink discharged from said printhead during a purge operation; and a carriage arranged to carry said blade supporting member between a wiping start position and a wiping end position, wherein said cap member covers said ink ejecting surface during said purge operation and moves away from said ink ejecting surface after said purge operation, and wherein said carriage reciprocates between said wiping start position and said wiping end position to allow said cleaning blade wiping said ink ejecting surface after said cap member has moved away from said ink ejecting surface.

52. The cleaning device according to claim 51, wherein said carriage stays at said wiping end position until said cap member moves away from said ink ejecting surface.

53. The cleaning device according to claim 51, wherein said carriage stays at said wiping start position with said cleaning blade located at said first blade position until said cap member moves away from said ink ejecting surface.

54. The cleaning device according to claim 27, further comprising:

a cap member arranged to cover at least a part of said ink ejecting surface of said printhead and receive ink discharged from said printhead during a purge operation; and a carriage arranged to carry said blade supporting member between a wiping start position and a wiping end position, wherein said cap member covers said ink ejecting surface during said purge operation and moves away from said ink ejecting surface after said purge operation, and wherein said carriage moves from said wiping end position to said wiping start position, stays at said wiping start position with said cleaning blade located at said first blade position until said purge operation is carried out, and then moves back to said wiping end position.

55. A method for cleaning an ink-jet printhead, comprising:

covering at least a part of an ink ejecting surface of the printhead with a cap member, the cap member being formed to receive ink discharged from the ink ejecting surface during a purge operation of the printhead;

moving the cap member away from the printhead after the purge operation to uncover the ink ejecting surface;

moving a cleaning blade after the purge operation from a wiping end position to a wiping start position while keeping the cleaning blade at a non-wiping attitude, the ink ejecting surface being not wiped when the cleaning blade kept at the non-wiping attitude passes by the ink ejecting surface;

moving back the cleaning blade from the wiping start position to the wiping end position while keeping the cleaning blade at a wiping attitude, the ink ejecting surface being wiped when the cleaning blade kept at the wiping attitude passes by the ink ejecting surface; and waiting for next purge operation with the cleaning blade located at the wiping end position.

56. The method according to claim 55, wherein the cleaning blade is supported by a blade supporting member, the blade supporting member being swingable toward and away from the ink ejecting surface, the blade supporting member disposing the cleaning blade to the wiping and non-wiping attitudes by swinging toward and away from the ink ejecting surface, respectively.

57. The method according to claim 56, wherein the cleaning blade is substantially perpendicular to the ink ejecting surface at the wiping attitude and inclines against the ink ejecting surface at the non-wiping attitude.

58. The method according to claim 55, further comprising:

bringing the cleaning blade located at the wiping end position into contact with a contact surface of a first ink absorber by disposing the cleaning blade at the non-wiping position, the contact surface of the first ink absorber being inclined against the ink ejecting surface.

59. The method according to claim 55, further comprising:

rubbing the tip portion of the cleaning blade against a first absorber arranged between the printhead and the wiping end position when the cleaning blade is moved from the wiping start position toward the wiping end position.

60. A method for cleaning an ink-jet printhead, comprising:

moving a cleaning blade from a wiping end position to a wiping start position while keeping the cleaning blade at a non-wiping attitude, the ink ejecting surface being not wiped when the cleaning blade kept at the non-wiping attitude passes by the ink ejecting surface;

covering at least a part of the ink ejecting surface with a cap member after the cleaning blade is moved to the wiping start position, the cap member formed to receive ink discharged from the ink ejecting surface during a purge operation of the printhead;

moving the cap member away from the printhead after the purge operation to uncover the ink ejecting surface;

moving back the cleaning blade from the wiping start position to the wiping end position after the cap member is moved away from the printhead, the cleaning blade being moved while keeping the cleaning blade at a wiping attitude, the ink ejecting surface being wiped when the cleaning blade kept at the wiping attitude passes by the ink ejecting surface; and waiting for next purge operation with the cleaning blade located at the wiping end position.

61. The method according to claim 60, wherein the cleaning blade is supported by a blade supporting member, the blade supporting member being swingable toward and away from the ink ejecting surface, the blade supporting member disposing the cleaning blade to the wiping and non-wiping attitudes by swinging toward and away from the ink ejecting surface, respectively.

62. The method according to claim 61, wherein the cleaning blade is substantially perpendicular to the ink ejecting surface at the wiping attitude and inclines against the ink ejecting surface at the non-wiping attitude.

63. The method according to claim 60, further comprising:

bringing the cleaning blade located at the wiping end position into contact with a contact surface of a first ink absorber by disposing the cleaning blade at the non-wiping attitude, the contact surface of the first ink absorber being inclined against the ink ejecting surface.

64. The method according to claim 60, further comprising:

rubbing the tip portion of the cleaning blade against a first absorber arranged between the printhead and the wiping end position when the cleaning blade is moved from the wiping start position toward the wiping end position.

65. A method for cleaning an ink-jet printhead, comprising:

covering at least a part of an ink ejecting surface of the printhead with a cap member, the cap member formed to receive ink discharged from the ink ejecting surface during a purge operation of the printhead;

moving the cap member away from the printhead after the purge operation to uncover the ink ejecting surface;

moving a cleaning blade after the purge operation from a wiping start position to a wiping end position while keeping the cleaning blade at a wiping attitude, the ink ejecting surface being wiped when the cleaning blade kept at the wiping attitude passes by the ink ejecting surface;

moving back the cleaning blade from the wiping end position to the wiping start position while keeping the cleaning blade at a non-wiping attitude, the ink ejecting surface being not wiped when the cleaning blade kept at the non-wiping attitude passes by the ink ejecting surface; and waiting for next purge operation with the cleaning blade located at the wiping start position.

66. The method according to claim 65, wherein the cleaning blade is supported by a blade supporting member, the blade supporting member being swingable toward and away from the ink ejecting surface, the blade supporting member disposing the cleaning blade to the wiping and non-wiping attitudes by swinging toward and away from the ink ejecting surface, respectively.

67. The method according to claim 66, wherein the cleaning blade is substantially perpendicular to the ink ejecting surface at the wiping attitude and inclines against the ink ejecting surface at the non-wiping attitude.

68. The method according to claim 65, further comprising:

bringing the cleaning blade located at the wiping end position into contact with a contact surface of a first ink absorber by disposing the cleaning blade at the non-wiping position, the contact surface of the first ink absorber being inclined against the ink ejecting surface.

69. The method according to claim 65, further comprising:

rubbing the tip portion of the cleaning blade against a first absorber arranged between the printhead and the wiping end position when the cleaning blade is moved from the wiping start position toward the wiping end position.

70. A cleaning device for cleaning an ink ejecting surface of an ink-jet printhead, comprising:

a cleaning blade arranged to wipe said ink ejecting surface with a tip portion thereof;

a blade supporting member arranged to support said cleaning blade, said blade supporting member being movable between first and second blade positions, said cleaning blade comes into contact with said ink ejecting surface to wipe said ink ejecting surface at said first blade position while being kept apart from said ink ejecting surface at said second blade position;

a first ink absorber having a side surface being inclined against said ink ejecting surface, said side surface coming into contact with said cleaning blade located at said second blade position to remove ink adhered to said cleaning blade; and a blade actuating member placed adjacent to said blade supporting member, said blade actuating member being movable toward and away from said blade supporting member, said blade actuating member make said blade supporting member to swing to said first blade position by moving toward and sliding under said blade supporting member, said blade actuating member allowing said blade supporting member to swing to said second blade position by moving away from said blade supporting member, wherein said blade supporting member is supported pivotably about an axis parallel to said ink ejecting surface, and wherein said blade supporting member swings toward said ink ejecting surface to locate said cleaning blade at said first blade position and swings away from said ink ejecting surface to locate said cleaning blade at said second blade position.

71. A cleaning device for cleaning an ink ejecting surface of an ink-jet printhead, comprising:

a cleaning blade arranged to wipe said ink ejecting surface with a tip portion thereof;

a blade supporting member arranged to support said cleaning blade, said blade supporting member being movable between first and second blade positions, said cleaning blade comes into contact with said ink ejecting surface to wipe said ink ejecting surface at said first blade position while being kept apart from said ink ejecting surface at said second blade position;

a first ink absorber having a side surface being inclined against said ink ejecting surface, said side surface coming into contact with said cleaning blade located at said second blade position to remove ink adhered to said cleaning blade; and an absorber vent formed in a vicinity of a lower end portion of said first ink absorber at a side opposite to said side surface coming into contact with said cleaning blade, ink absorbed into said first ink absorber being discharged through said absorber vent.

72. A cleaning device for cleaning an ink ejecting surface of an ink-jet printhead, comprising:

a cleaning blade arranged to wipe said ink ejecting surface with a tip portion thereof;

a blade supporting member arranged to support said cleaning blade, said blade supporting member being movable between first and second blade positions, said cleaning blade comes into contact with said ink ejecting surface to wipe said ink ejecting surface at said first blade position while being kept apart from said ink ejecting surface at said second blade position;

a first ink absorber having a side surface being inclined against said ink ejecting surface, said side surface coming into contact with said cleaning blade located at said second blade position to remove ink adhered to said cleaning blade;

a cap member arranged to cover at least a part of said ink ejecting surface of said printhead and receive ink discharged from said printhead during a purge operation; and a carriage arranged to carry said blade supporting member between a wiping start position and a wiping end position, wherein said cap member covers said ink ejecting surface during said purge operation and moves away from said ink ejecting surface after said purge operation, and wherein said carriage reciprocates between said wiping start position and said wiping end position to allow said cleaning blade wiping said ink ejecting surface after said cap member has moved away from said ink ejecting surface.

73. A cleaning device for cleaning an ink ejecting surface of an ink-jet printhead, comprising:

a cleaning blade arranged to wipe said ink ejecting surface with a tip portion thereof;

a blade supporting member arranged to support said cleaning blade, said blade supporting member being movable between first and second blade positions, said cleaning blade comes into contact with said ink ejecting surface to wipe said ink ejecting surface at said first blade position while being kept apart from said ink ejecting surface at said second blade position;

a first ink absorber having a side surface being inclined against said ink ejecting surface, said side surface coming into contact with said cleaning blade located at said second blade position to remove ink adhered to said cleaning blade;

a cap member arranged to cover at least a part of said ink ejecting surface of said printhead and receive ink discharged from said printhead during a purge operation; and a carriage arranged to carry said blade supporting member between a wiping start position and a wiping end position, wherein said cap member covers said ink ejecting surface during said purge operation and moves away from said ink ejecting surface after said purge operation, and wherein said carriage moves from said wiping end position to said wiping start position, stays at said wiping start position with said cleaning blade located at said first blade position until said purge operation is carried out, and then moves back to said wiping end position.

74. A cleaning device for cleaning an ink ejecting surface of an ink-jet printhead, comprising:

a cleaning blade arranged to wipe said ink ejecting surface with a tip portion thereof;

a blade supporting member arranged to support said cleaning blade, said blade supporting member being movable between first and second blade positions, said cleaning blade comes into contact with said ink ejecting surface to wipe said ink ejecting surface at said first blade position while being kept apart from said ink ejecting surface at said second blade position; and a first ink absorber having a side surface being inclined against said ink ejecting surface, said side surface coming into contact with said cleaning blade located at said second blade position to remove ink adhered to said cleaning blade, wherein said cleaning blade is not warped when said cleaning blade contacts said first ink absorber.

* * * * *